US006751914B2

(12) United States Patent
Zeh et al.

(10) Patent No.: US 6,751,914 B2
(45) Date of Patent: Jun. 22, 2004

(54) POST AND BEAM FURNITURE SYSTEM

(75) Inventors: Mark A. Zeh, Mountain View, CA (US); James R. Yurchenco, Palo Alto, CA (US); Peter S. Macdonald, Palo Alto, CA (US); Jonah L. Houston, Sunnyvale, CA (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 10/087,324

(22) Filed: Mar. 1, 2002

(65) Prior Publication Data

US 2003/0163958 A1 Sep. 4, 2003

(51) Int. Cl.[7] ..... E04H 1/00; E04H 14/00; E04H 5/00; E04H 3/00; E04H 6/00

(52) U.S. Cl. ..... 52/239; 52/36.1; 52/36.4; 403/170; 108/60; 248/223.41

(58) Field of Search ..... 52/36.1, 36.4, 52/239; 403/170, 12, 384, 387; 108/60, 50.01; 312/265.2, 265.3; 160/135; 248/223.41

(56) References Cited

U.S. PATENT DOCUMENTS

| | | | |
|---|---|---|---|
| 1,820,667 | A | 8/1931 | Leyes |
| 2,160,513 | A | 5/1939 | Pasternak |
| 2,248,715 | A | 7/1941 | Mafera |
| 2,281,482 | A | 4/1942 | Crayton |

(List continued on next page.)

FOREIGN PATENT DOCUMENTS

| | | |
|---|---|---|
| DE | 93366 | 10/1896 |
| DE | 2160513 | 6/1973 |
| DE | 2725637 | 12/1977 |
| DE | 3537135 | 4/1987 |
| DE | 4208193 | 9/1993 |
| DE | 19638221 | 4/1998 |
| FR | 1220067 | 5/1960 |
| FR | 2333993 | 7/1977 |
| FR | 0666425 | 8/1995 |
| GB | 962312 | 7/1964 |
| WO | WO0021412 | 4/2000 |

OTHER PUBLICATIONS

U.S. patent application Publication No. US 2001/0019096 A1; Sep. 6, 2001.

U.S. patent application Publication No. US 2001/0004099 A1; Jun. 21, 2001.

U.S. patent application Publication No. US 2001/0017009 A1; Aug. 30, 2001.

Bosch Aluminum Structural Framing System, "Everything to Build Anything," Bosch Automation Products, Buchanan, Michigan, 4 pages.

Herman Miller "Resolve" Post and Beam Workspace Management and Furniture System Brochure.

*Primary Examiner*—Carl D. Friedman
*Assistant Examiner*—Nahid Amiri
(74) *Attorney, Agent, or Firm*—Price, Heneveld, Cooper, DeWitt & Litton, LLP

(57) ABSTRACT

A post and beam furniture system having a plurality of horizontally-extending beams having a longitudinally-extending T-shaped first channel and a longitudinally, T-shaped second channel, and a plurality of vertical posts each having a lower portion thereof adapted to be abuttingly supported on a floor surface of an office space, and an upper portion thereof adapted to be connected with the horizontally-extending beams, and a longitudinally-extending T-shaped channel. The channels of the beams and posts receiving a plurality of connectors and accessories, including a multiple bracket post and beam connectors, a T-nut connector, and T-connector, an infill panel, a horizontally-extending two-part wire manager, a vertically extending wire manager, a vertically adjustable worksurface, a transactional surface, a swivel support for supporting a post thereon, and a universal utility hook.

37 Claims, 21 Drawing Sheets

U.S. PATENT DOCUMENTS 2,333,993 A 11/1943 Frailing
2,345,650 A 4/1944 Attwood
2,380,379 A 7/1945 Attwood
2,676,680 A 4/1954 Kindorf
2,696,139 A 12/1954 Attwood
2,784,812 A 3/1957 Kindorf
2,877,875 A 3/1959 Bolt
2,928,512 A 3/1960 Slater et al.
2,944,642 A 7/1960 Evans
3,049,161 A 8/1962 Attwood
3,053,355 A 9/1962 Attwood
3,381,438 A 5/1968 Bohnsack
3,456,549 A 7/1969 Horton
3,456,706 A 7/1969 Ollis, Jr.
3,483,910 A 12/1969 Londe et al.
3,557,857 A 1/1971 Swenson
3,759,297 A 9/1973 Anderson et al.
D229,610 S 12/1973 Shinjo
3,778,175 A 12/1973 Zimmer
3,901,612 A 8/1975 Canin
3,908,330 A 9/1975 Frach et al.
3,955,702 A 5/1976 Lundy
4,073,113 A 2/1978 Oudot et al.
4,143,698 A 3/1979 Smolka
4,146,074 A 3/1979 Kowalski
4,224,769 A 9/1980 Ball et al.
4,226,394 A 10/1980 Einhorn
4,248,558 A 2/1981 Lechner
4,377,360 A 3/1983 Kennedy
4,378,173 A 3/1983 Hopwell
D273,460 S 4/1984 Sturm
4,450,655 A 5/1984 Rosenthal et al.
4,506,399 A 3/1985 Espey et al.
4,575,295 A 3/1986 Rebentisch
4,677,794 A 7/1987 Parron et al.
4,772,000 A 9/1988 Aubert
4,784,552 A 11/1988 Rebentisch
4,826,112 A 5/1989 Rettler
4,826,117 A 5/1989 Bastian et al.
4,830,531 A 5/1989 Condit et al.
4,831,791 A * 5/1989 Ball ..... 52/36.1
4,903,452 A 2/1990 Huang
4,905,428 A * 3/1990 Sykes ..... 52/126.4
4,950,099 A 8/1990 Roellin
4,957,402 A 9/1990 Klein et al.
4,961,553 A 10/1990 Todd
D312,177 S 11/1990 Walter
4,979,554 A 12/1990 Nelson
D314,482 S 2/1991 Walter et al.
D315,651 S 3/1991 Citterio et al.
5,076,748 A 12/1991 Waterfield et al.
5,154,385 A 10/1992 Lindberg et al.
5,195,286 A 3/1993 DeLong et al.
5,199,836 A 4/1993 Gogarty
5,271,586 A 12/1993 Schmidt
5,277,007 A 1/1994 Hellwig et al.
5,277,512 A 1/1994 Dwillies
5,359,826 A 11/1994 Grearson
5,362,923 A 11/1994 Newhouse et al.
5,364,311 A 11/1994 Chou
5,375,798 A 12/1994 Hungerford, Jr.
5,375,802 A 12/1994 Branham, II
5,394,658 A 3/1995 Schreiner et al.
5,394,668 A * 3/1995 Lim ..... 52/483.1
5,398,909 A 3/1995 Sandwith
5,429,252 A 7/1995 Liu
5,444,958 A 8/1995 Lu
5,489,173 A 2/1996 Hofle
5,551,178 A 9/1996 Foley et al.
5,606,919 A 3/1997 Fox et al.
D378,731 S 4/1997 Kopish
5,628,598 A 5/1997 Hofle
5,634,300 A 6/1997 Huebner et al.
5,675,944 A 10/1997 Kerr et al.
5,675,949 A 10/1997 Forsulund et al.
5,687,513 A 11/1997 Baloga et al.
5,689,926 A 11/1997 Nichols
5,737,801 A 4/1998 Flood
5,768,840 A 6/1998 Feldpausch et al.
5,775,521 A 7/1998 Tisbo
5,803,146 A 9/1998 Boon
5,826,639 A 10/1998 Miller
5,831,211 A 11/1998 Gartung et al.
5,833,417 A 11/1998 Sargent et al.
D404,010 S 1/1999 Viklund et al.
5,881,500 A 3/1999 Latino et al.
5,899,025 A 5/1999 Casey et al.
5,901,513 A * 5/1999 Mollenkopf et al. ..... 52/220.7
5,901,523 A 5/1999 Tasi
5,934,623 A 8/1999 Kopish
5,949,025 A 9/1999 Nagai et al.
5,950,371 A 9/1999 Rives et al.
5,970,675 A 10/1999 Schray
D415,901 S 11/1999 Arko et al.
5,974,742 A 11/1999 Schreiner et al.
6,000,179 A * 12/1999 Musculus et al. ..... 52/239
6,003,275 A 12/1999 Cornell et al.
6,009,930 A 1/2000 Jantschek
6,037,538 A 3/2000 Brooks
6,038,802 A 3/2000 Tidwell
6,067,762 A 5/2000 Greer et al.
6,073,399 A 6/2000 Shipman et al.
6,086,300 A 7/2000 Frohlich
6,125,600 A 10/2000 Bastian
6,131,866 A 10/2000 Kesinger
6,206,206 B1 3/2001 Saylor et al.
6,227,384 B1 5/2001 Saylor et al.
D445,456 S 7/2001 Saylor et al.
6,267,338 B1 7/2001 Saylor et al.
6,279,643 B1 8/2001 Shipman
6,282,854 B1 9/2001 Vos et al.
6,302,366 B1 10/2001 Saylor et al.
6,481,169 B1 * 11/2002 Ludwig et al. ..... 52/239

* cited by examiner

POST AND BEAM FURNITURE SYSTEM

BACKGROUND OF THE INVENTION

The present invention relates to furnishing for open office spaces and the like, and in particular to a plurality of connectors and accessories for post and beam furniture systems.

Portable partition systems for open office space and other similar settings are well known in the art. Individual partition panels are interconnected in different configurations to form separate offices, workstations, and/or work settings. The particular panels are extremely durable and can be readily disassembled and reassembled into alternative configurations to meet the ever-changing needs of the user. Examples of such partition systems are provided in U.S. Pat. Nos. 3,822,146; 3,831,330; and 4,144,920, which are owned by Steelcase Development Corporation, the assignee of the present application.

Post and beam furniture systems have also been developed to divide open office plans three-dimensionally into individual workstations and/or work settings. Examples of such furniture systems are provided in U.S. Pat. Nos. 6,003,275; 5,950,371; and 5,899,025, which are also owned by Steelcase Development Corporation, the assignee of the present application.

SUMMARY OF THE INVENTION

One aspect of the present invention is to provide in a post and beam furniture system of the type having a plurality of overhead beams, each having a longitudinally-extending first channel and a longitudinally-extending second channel, and a plurality of vertical posts each having a lower portion thereof adapted to be abuttingly supported on a floor surface of the open office space, an upper portion thereof adapted to be connected with an associated one of the beams, and at least one longitudinally-extending T-shaped channel, the improvement of a connector assembly comprising a first L-shaped bracket having a body portion and an end portion extending substantially orthogonal to the body portion, wherein the body portion of the first bracket is mounted in the first channel of an associated one of the beams, and a second L-shaped bracket having a body portion and an end portion extending substantially orthogonal to the body portion, and wherein the body portion of the second bracket is mounted in the second channel of the one beam. The connector assembly also comprising a first T-shaped connector having a body portion and a pair of flanges extending outwardly from the body portion of the first connector, wherein the flanges of the first connector are mounted in the channel of an associated one of the posts, and wherein the first connector is connected with the first bracket, thereby connecting the one beam with the one post at a first location, and a second T-shaped connector having a body portion and a pair of flanges extending outwardly from the body portion of the second connector, wherein the flanges of the second connector are mounted in the channel of the one post, and wherein the second connector is connected with second bracket, thereby connecting the one beam with the one post at a second location.

Another aspect of the present invention is to provide in a post and beam furniture system of the type having a plurality of overhead beams, and a plurality of vertical posts each having a lower portion thereof adapted to be abuttingly supported on a floor surface of an open office space, an upper portion thereof adapted to be connected with an associated one of the beams, and a longitudinally-extending channel, the improvement of a positioning clip that comprises a body section having a first end and a second end, wherein the body section is mounted in the channel of an associated one of the posts, and an engagement portion located at the first end of the body section and engaging the one post. The positioning clip also comprises a support portion located at the second end of the body section, received within the channel of the one post, and supporting a partition connector thereon prior to assembly of an associated one of the beams with the one post.

Yet another aspect of the present invention is to provide in a post and beam furniture system of the type having a plurality of overhead beams, and a plurality of vertical posts each having a lower portion thereof adapted to be abuttingly supported on a floor surface of an open office space, an upper portion thereof adapted to be connected with an associated one of the beams, and a longitudinally-extending T-shaped channel, the improvement of a connector that comprises a substantially rectangular body portion having a first end and a second end, and a pair of outwardly-extending flanges located at the end of the body portion, wherein each flange has a distal end, an outer surface located away from the body portion, and an inner surface juxtaposed across the flange from the outer surface, and wherein each flange also has a shoulder extending outwardly from the inner surface. The body portion and flanges of the connector cooperate to define a substantial T-shape and are mounted in the channel of an associated one of the posts. The shoulder of each flange is received within a corresponding groove within the channel of the one post. The second end of the body is connected to an associated one of the beams.

Yet another aspect of the present invention is to provide in a post and beam furniture system of the type having a plurality of overhead beams, and a plurality of vertical posts each having a lower portion thereof adapted to be abuttingly supported on a worksurface of an open office space, an upper portion thereof adapted to be connected with an associated one of the beams, and a longitudinally-extending T-shaped channel, the improvement of a connector that comprises a pair of end walls, and a pair of side walls, wherein the end walls and the side walls cooperate to define a substantially parallelogram-shaped body received within the channel of an associated one of the posts, and wherein the body is rotatable within the channel of the one post until the end walls of the body abut a pair of interior walls within the channel of the one post. The connector also comprises a first surface, and a second surface juxtaposed from the first surface and having a raised center portion, wherein the center portion is defined by a pair of engagement walls that extend outwardly from the second surface and substantially parallel to the end walls, the engagement walls abut a neck portion of a channel of the one post when the end walls abut the interior walls of the channel of the one post, and wherein the center portion of the second surface is connected to an associated one of the beams, thereby connecting the one beam with the one post.

Still yet another aspect of the present invention is to provide in a post and beam furniture system of the type having a plurality of horizontally-extending beams each having a longitudinally-extending channel, and a plurality of vertical posts each adapted to be abuttingly supported on a floor surface of an open office space and connected with an associated one of the beams, and having a longitudinally-extending channel, the improvement of a panel system that comprises a flexible sheet member having a first end and a second end. The panel system also comprises a first bracket assembly connected to the first end of the sheet member and mounted in the channel of an associated one of the beams, and a second bracket assembly that includes an elastically-deformable cord extending laterally across the second end of the flexible sheet and connected thereto, wherein the cord includes a first end a second end mounted in the channels of an associated pair of the posts. The first bracket assembly and the second bracket assembly engage the channels of the one beam and the pair of posts, respectively, and cooperate to resiliently retain the sheet member in a substantially planar condition.

Yet another aspect of the present invention is to provide in a post and beam furniture system of the type having a plurality of horizontally-extending beams each having a longitudinally-extending T-shaped channel, and a plurality of vertical posts each adapted to be abuttingly supported on a floor surface of an open office space, and adapted to be connected with the beams, the improvement of a wire manager that comprises at least one engagement clip having a T-shaped first portion mounted in the channel of an associated one of the beams, and a second portion that includes a first segment of a coupler, and a U-shaped utility tube that defines an interior space therein, and that includes a second segment of the coupler, wherein the first and second segments of the coupler are snappingly coupled.

Yet another aspect of the present invention is to provide in a post and beam furniture system of the type having a plurality of overhead beams, a plurality of vertical posts each having a lower portion thereof adapted to be abuttingly supported on a floor surface of an open office space, an upper portion thereof adapted to be connected with an associated one of the beams, a first longitudinally-extending channel, and a second longitudinally-extending channel, the improvement of a wire manager that comprises a first bracket engaged with the first channel of an associated one of the posts, and a second bracket engaged with the second channel of the one post, and interlocking with the first bracket, thereby biasing the first and second brackets into frictional engagement with the one post. The wire manager also comprises a utility tube defining a longitudinally-extending interior, and that is connected with the first and second brackets, thereby supporting the utility tube from the one post.

Still yet another aspect of the present invention is to provide in a post and beam furniture system of the type having a plurality of horizontally-extending beams at least some of which having a first channel extending longitudinally along a side surface thereof and a second channel extending longitudinally along a bottom surface thereof, and a plurality of vertical posts each adapted to be supported on a floor surface of an open space and connected with the beams, the improvement of a wire manager that comprises a worksurface, and at least one supporting bracket assembly that includes a first engagement member that engages the first channel of an associated one of the beams, and a second engagement member that engages the second channel of the one beam, and an outwardly-extending support arm connected to the worksurface supporting the worksurface from the one beam.

Yet another aspect of the present invention is to provide in a post and beam furniture system of the type having a plurality of horizontally-extending beams at least some of which having a T-shaped first channel extending longitudinally along a top surface thereof and a T-shaped second channel extending longitudinally along a side surface thereof, and a plurality of vertical posts adapted to be abuttingly supported on a floor surface of the open office plan and connected with the beams, the improvement of a worksurface assembly that comprises a worksurface, and at least one supporting bracket that includes a first engagement member that engages the first channel of an associated one of the beams, a second engagement member that engages the second channel of the one beam, and an outwardly-extending support arm connected to the support surface and supporting the worksurface thereon.

Another aspect of the present invention is to provide in a post and beam furniture system of the type having a plurality of overhead beams, and a plurality of vertical posts each having a lower portion thereof adapted to be abuttingly supported on a floor surface of an open office space, and an upper portion thereof adapted to be connected with an associated one of the overhead beams, the improvement of a swivel support assembly that comprises an annularly-shaped puck having a flat bottom surface adapted to be abuttingly supported on the floor surface, an upper surface, and a side edge beveled outwardly from the upper surface to the bottom surface, wherein the beveled side edge provides a bearing surface. The swivel support assembly also comprises a generally circular foot plate that includes an upper surface and a downwardly facing frusto-conical surface shaped to closely receive the beveled side edge of the puck, wherein the foot plate is operably connected to an associated one of the posts and permits the post to be laterally adjusted with respect to an associated one of the beams.

Still yet another aspect of the present invention is to provide a post and beam furniture system of the type having a plurality of horizontally-extending beams, and a plurality of vertical posts each having a lower portion thereof adapted to be abuttingly supported on a worksurface of an open office space, and an upper portion thereof adapted to be connected with an associated one of the beams, wherein at least a select one of the beams and posts includes a longitudinally-extending T-shaped channel, the improvement including a universal utility hanger that comprises a body that includes a first portion that is generally hook-shaped having a circular central aperture that communicates with an outwardly-extending slot, a second portion that is generally T-shaped having a generally cylindrical neck, and a pair of flanges extending outwardly from the neck and forming a generally T-shape therewith, wherein the flanges are slidingly received within the longitudinally-extending T-shaped channel, and a third portion located between the first and second portions that is generally disk-shaped, and includes an exterior thread. The hanger also comprises a detachable ring having a generally annular shape and that includes an interior thread, wherein the detachable ring is threadably mated with the third portion of the body and contacts an outer surface of the channel.

DETAILED DESCRIPTION OF THE PREFERRED EMBODIMENTS

Figure 1:
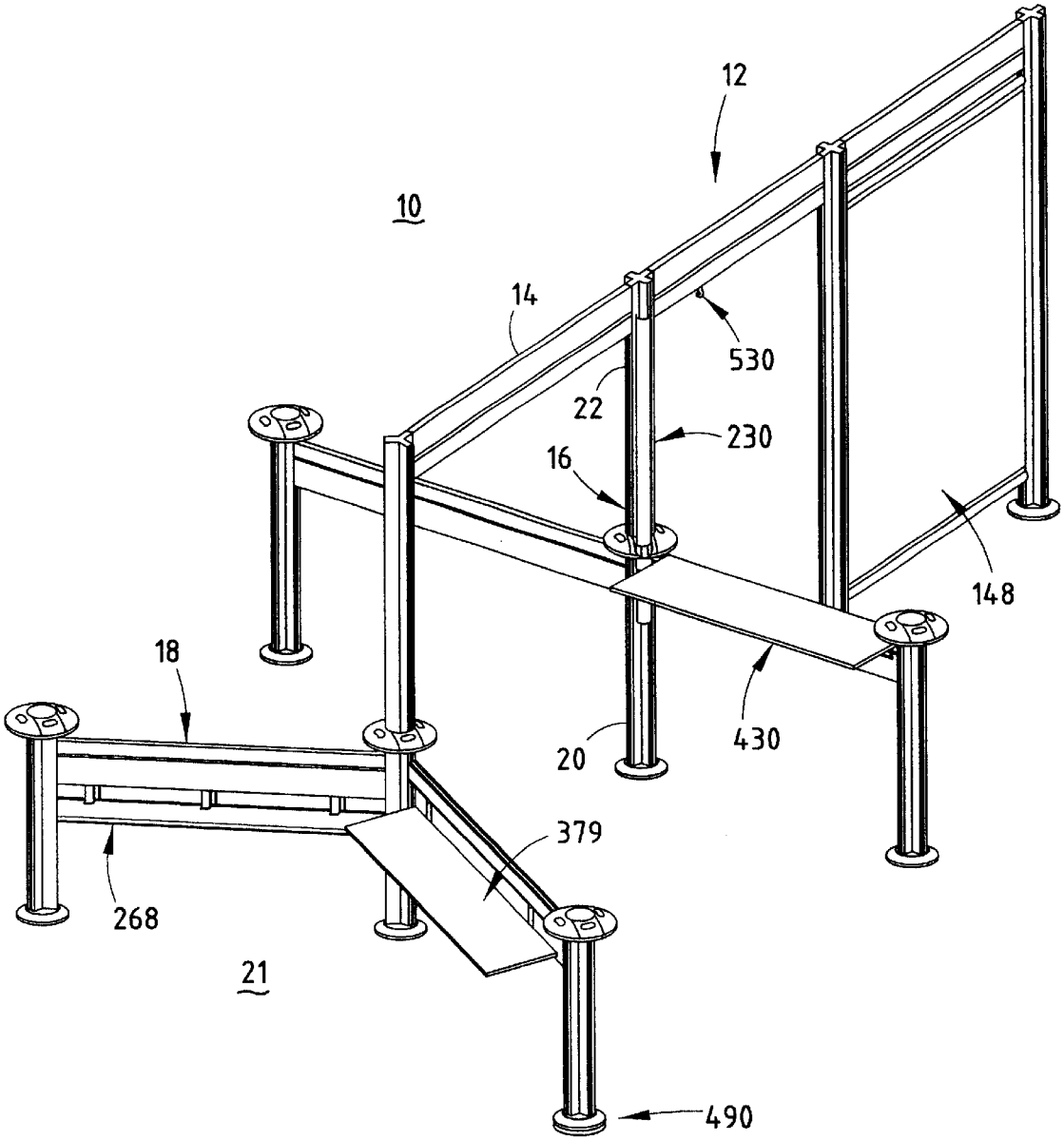
FIG. 1 is a perspective view of a post and beam furniture system embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
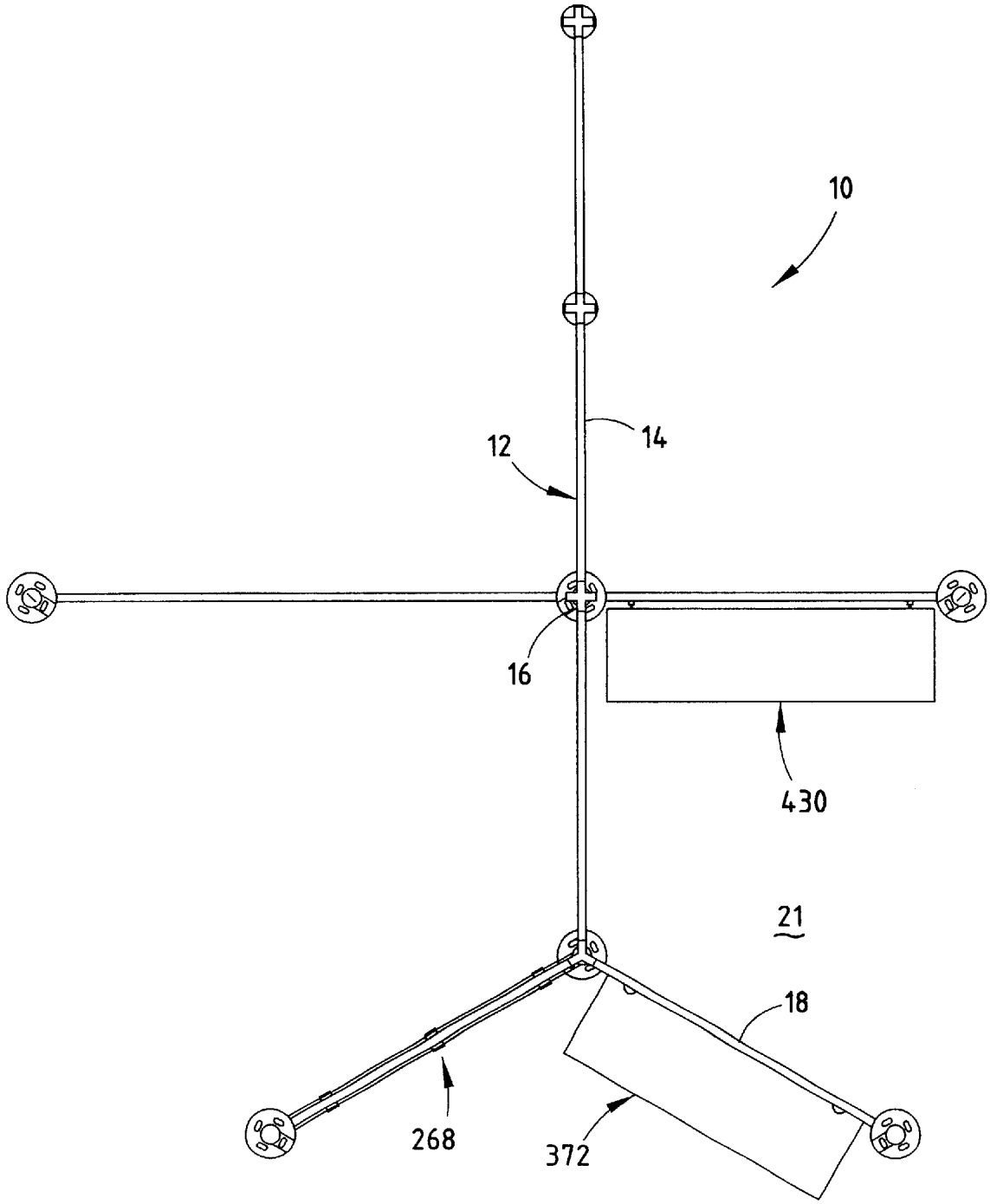
FIG. 2 is a top plan view of the post and beam furniture system.

The reference numeral 10 (FIGS. 1 and 2) generally designates a post and beam furniture system embodying the present invention. The prefabricated furniture system 10 is of the type that is designed for use in open building plans and the like, and includes a freestanding portable partition system 12 that includes a plurality of horizontally-extending overhead beams 14 interconnected to define an overhead framework, a plurality of vertically extending posts or support columns 16, and a plurality of horizontally-extending mid-height beams 18. Posts 16 each include a lower end 20 abuttingly supported on a building floor surface 21, and an upper end 22 connected with the overhead framework as formed by overhead beams 14.

Figure 3:
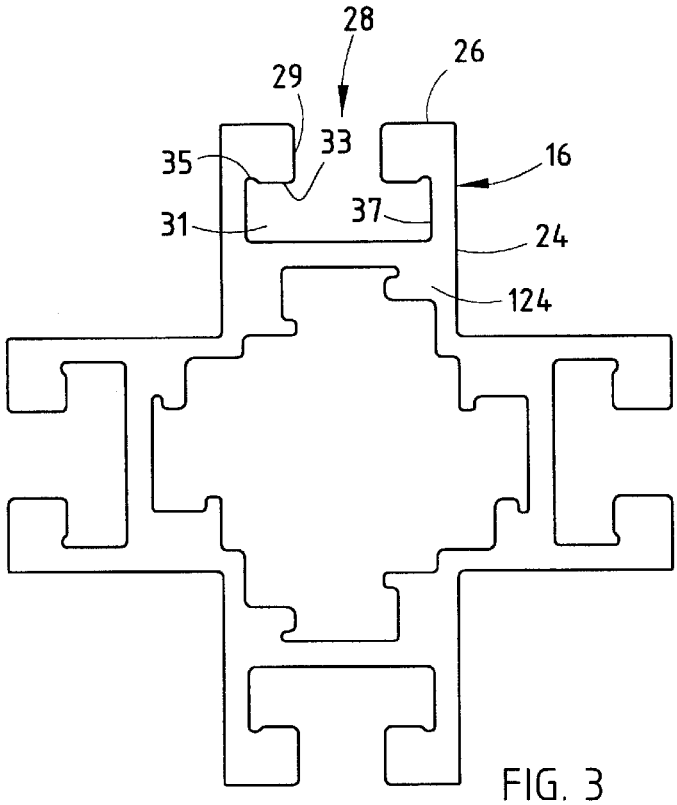
FIG. 3 is an end view of a vertically oriented post having an X-shaped cross-sectional geometry.
Figure 4:
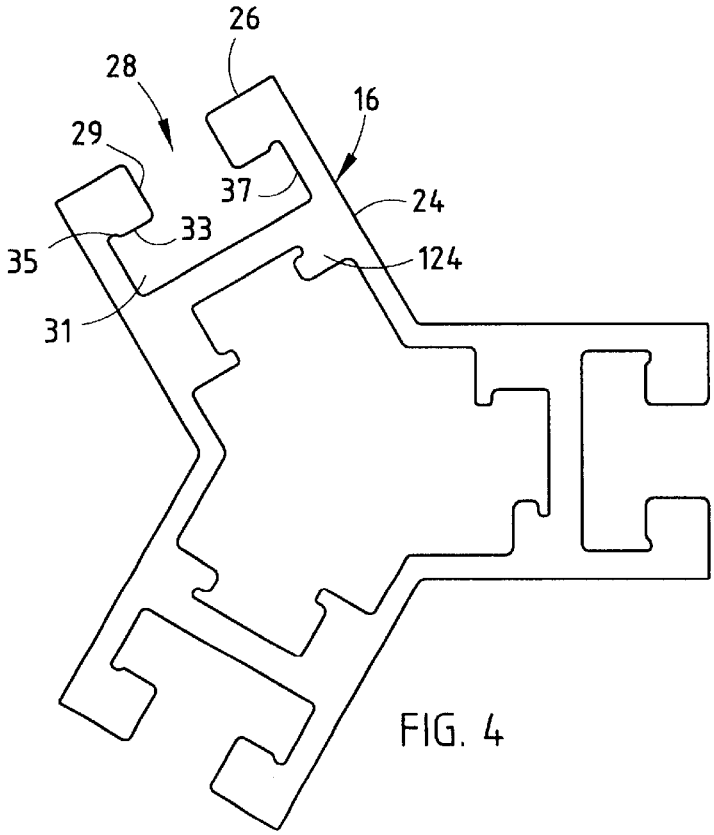
FIG. 4 is an end view of a vertically oriented post having a Y-shaped cross-sectional geometry.

The posts 16 associated with the illustrated post and beam furniture system 10 are provided in T, X, L, and Y configurations, wherein each projecting leg or flange 24 of each post 16 includes a T-shaped channel. For example, a post 16 having an X-shaped configuration is illustrated in FIG. 3, which incorporates four projecting legs or flanges 24 which are disposed in a mutually-perpendicular relationship to define a cruciform shape. Each end face 26 of each of the flanges 24 incorporates a T-shaped channel 28 along the entire length thereof. A post 16 having a Y-shaped configuration, is illustrated in FIG. 4 and incorporates three projecting legs or flanges 24 which are disposed in a mutually-perpendicular relationship. Similar to the X-shape support columns of FIG. 3, each face 26 of each of the flanges 24 incorporates a T-shaped channel 28 along the entire length thereof. As best illustrated in FIGS. 3 and 4, each of the T-shaped channels 28 of posts 16 includes a narrowed neck portion 29 providing access to an enlarged interior portion 31 partially defined by an inner channel wall 33 and a side wall 37. Each inner channel wall 33 includes a longitudinally-extending, distally located groove 35. Each channel 28 has a T-shaped lateral cross-sectional configuration which is adapted to detachably receive and capture mating fasteners therein, as discussed below.

Figure 5:
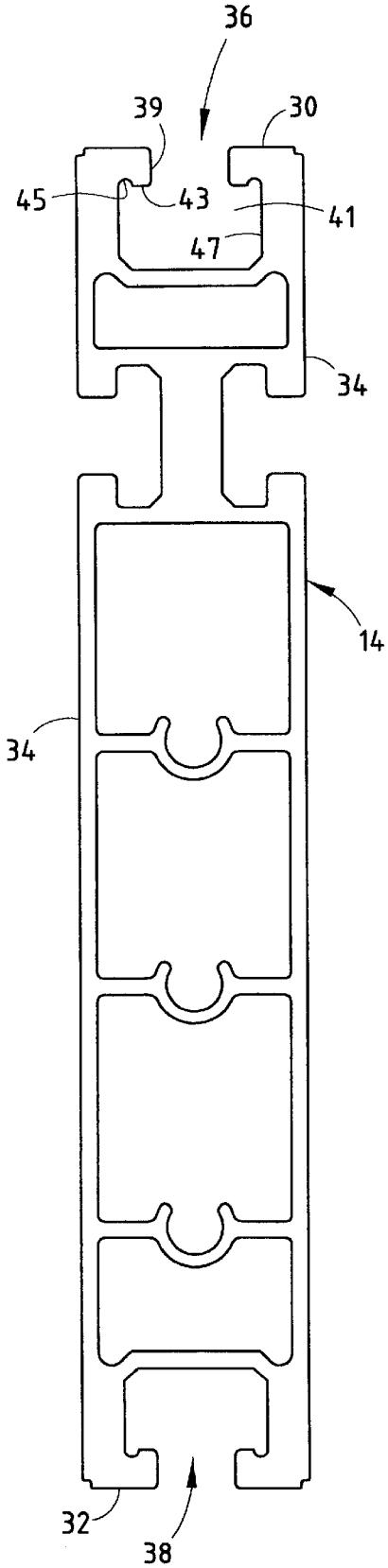
FIG. 5 is an end view of a horizontally oriented, overhead beam.
Figure 6:
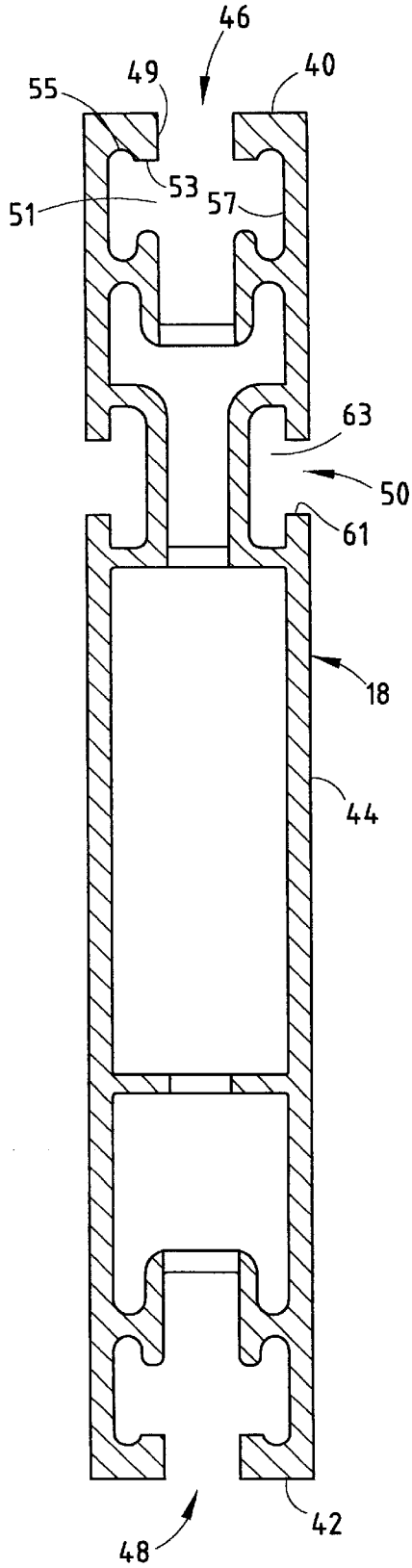
FIG. 6 is a cross-sectional end view of a horizontally oriented mid-height beam.

Each overhead beam 14 (FIG. 5) associated with the illustrated post and beam furniture system 10 includes an upper face 30, a bottom face 32, and side faces 34. Upper face 30 of overhead beam 14 incorporates a T-shaped channel 36 along the entire length thereof. Bottom face 32 incorporates a T-shaped channel 38 along the entire length thereof. Each of the T-shaped channels 36 and 38 includes a narrowed neck portion 39 providing access to an enlarged interior portion 41 partially defined by an inner channel wall 43 and a side wall 47. Each inner channel wall 43 includes a longitudinally-extending, distally located groove 45. Each of the channels 36 and 38 have a T-shaped lateral cross-sectional configuration which is adapted to detachably receive and capture mating fasteners therein, such as those described below.

Each mid-height beam 18 associated with the illustrated post and beam furniture system 10 includes an upper face 40, a lower face 42, and side faces 44. Upper face 40 of each mid-height beam 18 incorporates a T-shaped channel 46 along the entire length thereof, while each lower face 42 incorporates a T-shaped channel 48 along the entire length thereof. Each of the T-shaped channels 36 and 38 includes a narrowed neck portion 49 providing access to an enlarged interior portion 51 partially defined by an inner channel wall 53 and side walls 57. Each inner channel wall 53 includes a longitudinally-extending, distally located groove 55. Each side face 44 of each mid-height beam 18 incorporates a T-shaped channel 50 extending along the entire length thereof that are juxtaposed across mid-height beam 18. Each of the T-shaped channels 46, 48 and 50 of mid-height beam 18 includes a narrowed neck portion 61 providing access to an enlarged interior portion 63. Each of the channels 36, 38, 48 and 50 have a T-shaped lateral cross-sectional configuration which is adapted to detachably receive and capture mating fasteners and connectors therein, such as those discussed below.

Figure 7A:
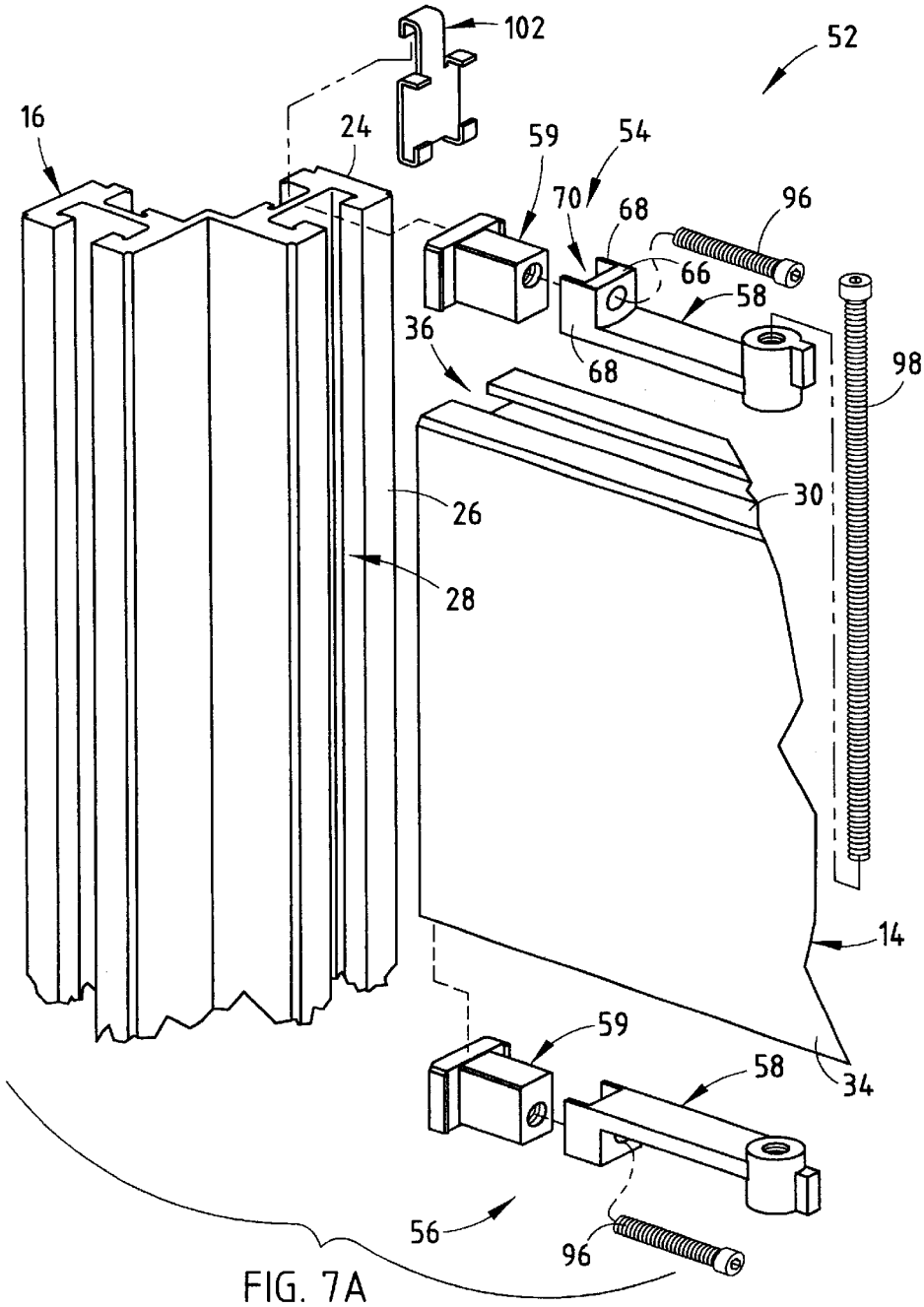
FIG. 7A is an exploded perspective view of a connector assembly for connecting the horizontally-extending beam to the vertically extending post.
Figure 8:
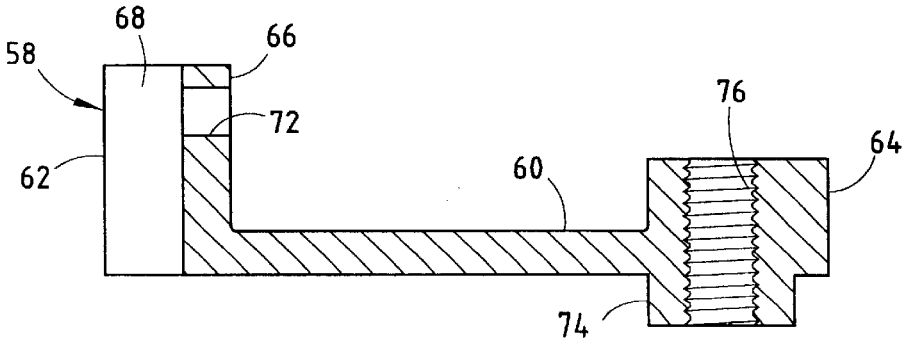
FIG. 8 is a cross-sectional front elevational view of an L-shaped bracket of the connector assembly.
Figure 9:
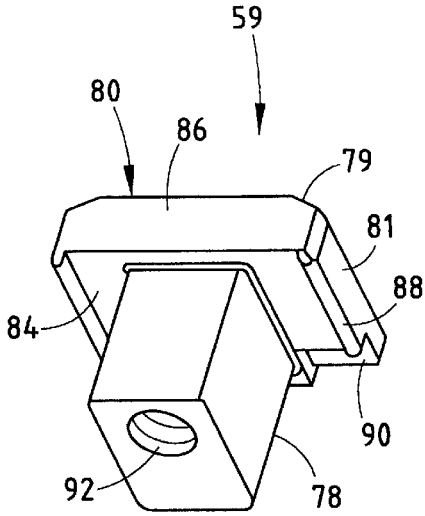
FIG. 9 is a perspective view of a T-shaped connector of the connector assembly.

The reference numeral 52 (FIG. 7) generally designates a connector assembly that includes an upper bracket assembly 54 and a lower bracket assembly 56. As upper bracket assembly 54 and lower bracket assembly 56 are substantially similar, a description of upper bracket assembly 54 should be considered descriptive of both upper bracket assembly 54 and lower bracket assembly 56. Upper bracket assembly 54 includes an L-shaped bracket 58 (FIG. 8) and a T-shaped connector 59 (FIG. 9). Bracket 58 includes a rectangularly-shaped body portion 60, a U-shaped end portion 62 extending orthogonally from body portion 60, and a cylindrically shaped anchor end 64 extending orthogonally from body portion 60 and juxtaposed along the length of body portion 60 from end portion 62. End portion 62 includes an end wall 66 extending orthogonally and upwardly from body portion 60, and a pair of receiving flanges 68 extending outwardly from end wall 66 and forming a pocket 70 therebetween. End wall 66 includes an aperture 72 extending therethrough and adapted to receive a mechanical fastener therein as described below. Anchor portion 64 of bracket 58 is cylindrically shaped and extends orthogonally from body portion 60. Body portion 60 and anchor portion 64 are configured such that anchor portion 64 extends below body portion 60, thereby creating a shoulder 74. Anchor portion 64 includes a vertically oriented, centrally-located, threaded aperture 76 extending therethrough, and adapted to receive a mechanical fastener therein as described below.

Figure 10:
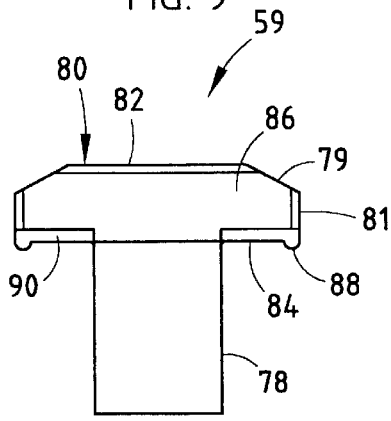
FIG. 10 is a side view of the T-shaped connector of the connector assembly.
Figure 11:
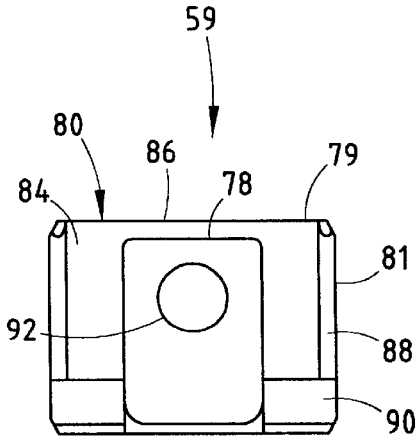
FIG. 11 is an end view of the T-shaped connector of the connector assembly.

The connector 59 (FIGS. 9–11) of upper bracket assembly 54 has a T-shaped lateral cross-sectional configuration which is adapted to be mounted and captured within channel 28 of post 16. Each connector 59 includes a rectangularly-shaped body portion 78 and a pair of flanges 79 that cooperate to form a head 80 that extends outwardly from body portion 78 and forms a T-shape therewith. Head 80 is defined by a pair of distally located end surfaces 81, an outer surface 82 located away from body portion 78, an inner surface 84 juxtaposed across head 80 from outer surface 82, and side surfaces 86. Outer surface 82, inner surface 84 and side surface 86 of head 80 cooperate to form a substantially rectangular box-like shape. Head 80 further includes a pair of distally located rounded shoulders 88 extending outwardly from inner surface 84 and substantially across the width of head 80 as defined between side surfaces 86. The inner surface 84 of head 80 includes a pair of inwardly-extending, rectangularly-shaped notches 90. Connector 59 further includes a longitudinally-extending threaded aperture 92 extending through body portion 78 and head 80.

Figure 12:
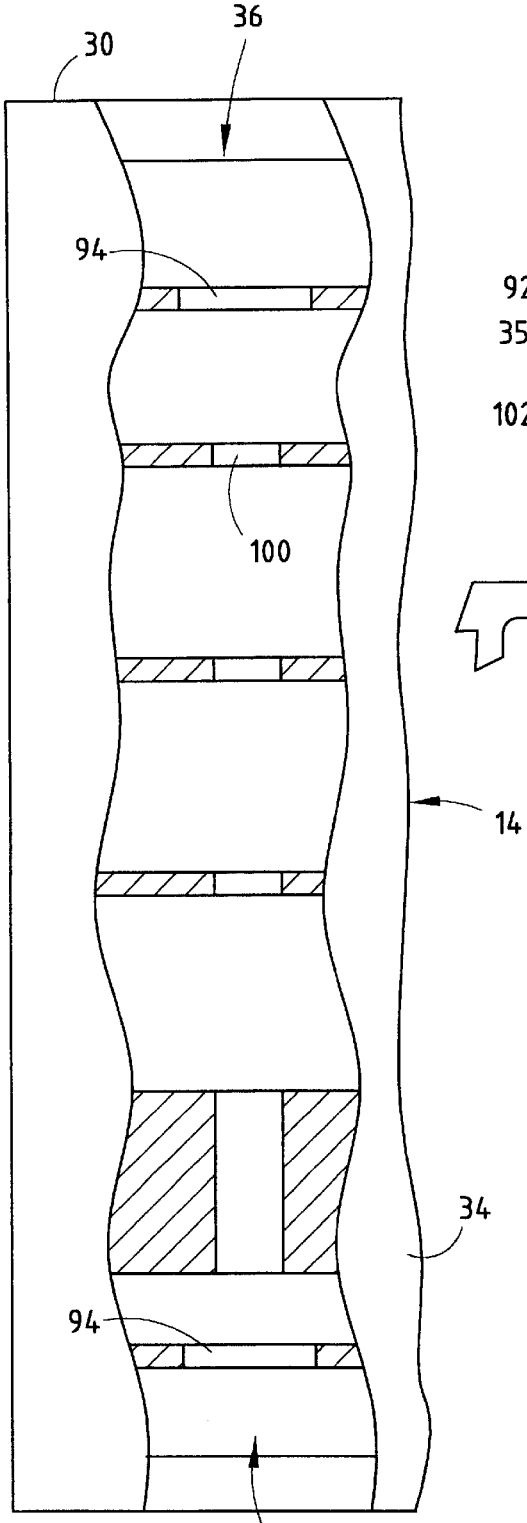
FIG. 12 is a fragmentary cross-sectional view of the beam.
Figure 13:
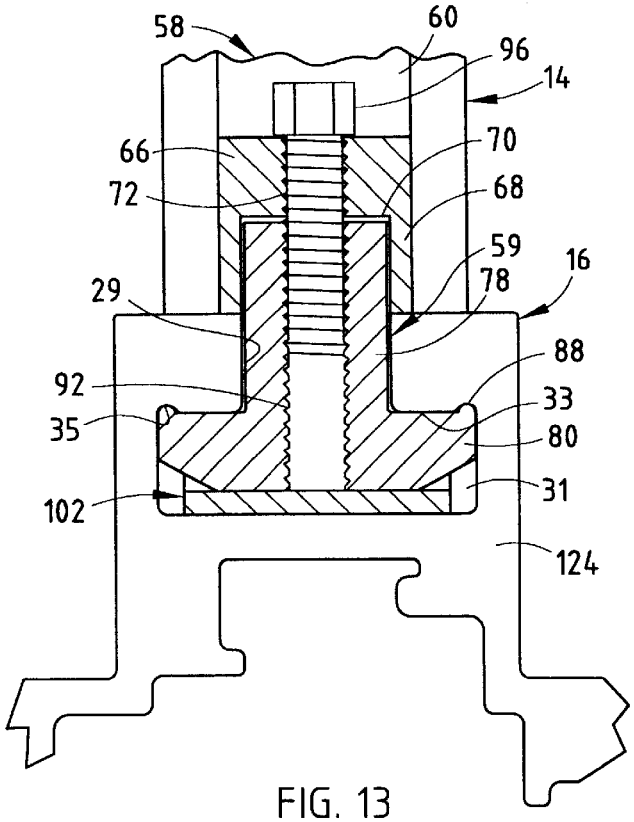
FIG. 13 is a fragmentary cross-sectional top plan view of the L-shaped bracket and the T-shaped connector mounted in the post.

In assembly, upper bracket assembly 54 and lower bracket assembly 56 extend within channel 28 of post 16 and channels 36 and 38 of overhead beam 14 and are connected thereto, thereby connecting overhead beam 14 with post 16. Specifically, bracket 58 of upper bracket assembly 54 is positioned within upper channel 36 of beam 14 such that shoulder 74 of bracket 58 of upper bracket assembly 54 is positioned within a cylindrically-shaped recess 94 (FIG. 12) located within upper channel 36, thereby assuring proper alignment of bracket 58 with respect to beam 14. Connector 59 of upper bracket assembly 54 is slidingly placed within channel 28 of post 16 such that head 80 of connector 59 is received within inner portion 31 of channel 28 and body portion 78 of connector 59 extends outwardly from channel 28 through neck portion 29 thereof. As best illustrated in FIG. 13, bracket 58 and connector 59 of upper bracket assembly 54 are connected by placing body portion 78 of connector 59 into pocket 70 of bracket 58 thereby providing lateral alignment of connector 59 with respect to bracket 58. A mechanical fastener such as bolt 96 extends through aperture 72 of bracket 58 and is threadably received within threaded aperture 92 of connector 59. Bolt 96 draws head 80 of connector 59 into frictional engagement with inner channel walls 33 and shoulders 68 into engagement with grooves 35 of channel 28, thereby frictionally locking upper bracket assembly 54 within channel 28 of post 16. Lower bracket assembly 56 is assembled with respect to beam 14 and post 16 in a similar manner to that of upper bracket assembly 54. A connecting rod 98 is threadably received within aperture 76 of bracket 58 of upper bracket assembly 54, extends downwardly through an aperture 100 extending vertically through beam 14, and is threadably received within aperture 76 of bracket 58 of lower bracket assembly 56, thereby connecting upper bracket assembly 54 and lower bracket assembly 56 with beam 14. Upper bracket assembly 54 and lower bracket assembly 56 cooperate to retain beam 14 at a particular vertical height with respect to post 16.

Figure 7B:
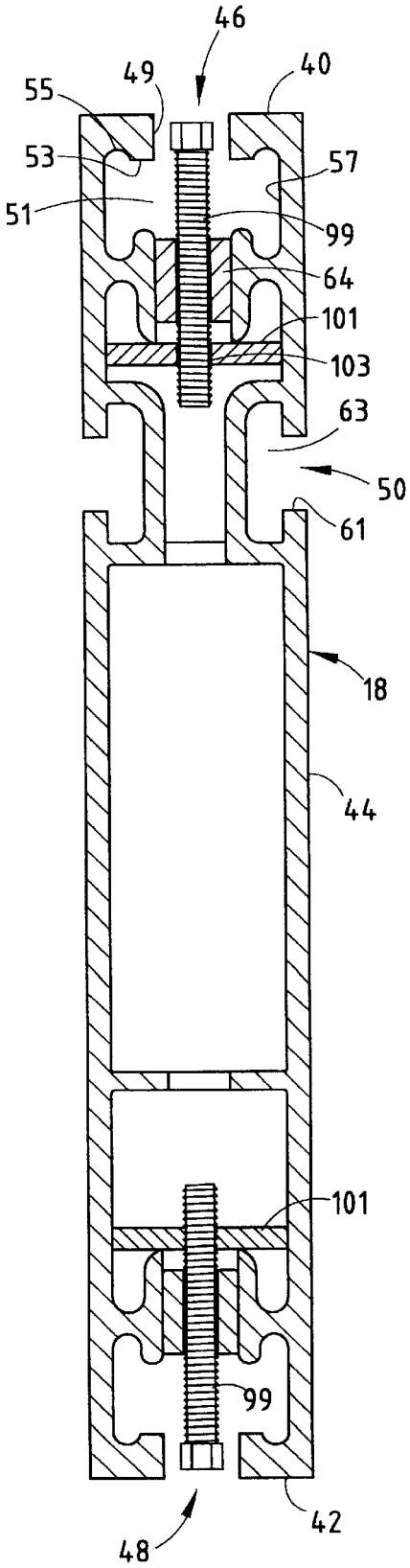
FIG. 7B is a partial cross-sectional view of an alternative embodiment of the connector assembly.

In an alternative embodiment, as shown in FIG. 7B, connecting rod 98 is replaced by a pair of bolts 99 that extend through aperture 76 of an associated connector bracket 58, and a pair of nut-plates 101 each having a threaded aperture 103 that receives the associated bolt 99, thereby operably connecting the upper and lower bracket assemblies 54 and 56 with beam 14.

Figure 14:
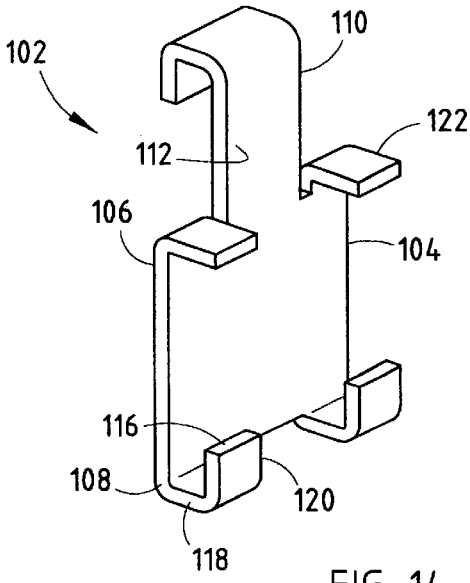
FIG. 14 is a perspective view of a positioning clip that supports the T-shaped connector of the connector assembly while assembly the horizontal member with the vertical member.

A positioning clip 102 (FIG. 14) is utilized to assist in assembling beam 14 with post 16. Positioning clip 102 includes a planar body section 104 having an upper end 106 and a lower end 108, and is received within inner portion 31 of channel 28 of post 16. A hook-shaped engagement portion 110 extends upwardly from upper end 106 of body section 104 and includes a centrally-located neck 112 and an outwardly-extending engagement hook 114. Positioning clip 102 also includes a pair of hooks 116 that extend inwardly from and are juxtaposed across body section 104. Each hook 116 includes a horizontally-extending support portion 118 and a vertically extending engagement portion 120 that are adapted to engage an associated connector 59 of upper bracket assembly 54 as described below. Positioning clip 102 further includes a pair of inwardly-extending retention fingers 122 that prevents the associated connector 59 to be slid within channel 28 upwardly past fingers 122 as described below.

In assembly, head 80 of connector 59 of upper bracket assembly 54 is placed proximate body section 104 of positioning clip 102 such that head 80 of connector 59 rests upon support portion 118 of hooks 116 and engagement portion 120 of each hook 116 engages notches 90 of head 80. The assembly of beam 14, upper bracket assembly 54 and lower bracket assembly 56 is then aligned with post 16 by vertically sliding head 80 of connector 59 of both the upper bracket assembly 54 and lower bracket assembly 56 along inner portion 31 of channel 28 until hook 114 of engagement portion 110 of positioning clip 102 rests upon an upper surface 124 of post 16. Positioning clip 102 supports beam 14, upper bracket assembly 54 and lower bracket assembly 56 until bolts 96 of upper bracket assembly 54 and lower bracket assembly 56 are tightened therein, thereby assuring proper vertical alignment of beam 14 along post 16 during assembly.

Figure 15:
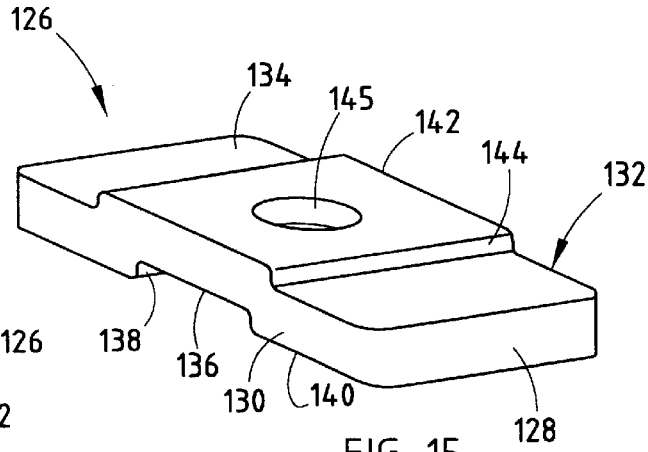
FIG. 15 is a perspective view of a T-nut of an alternative embodiment of the connector assembly.
Figure 16:
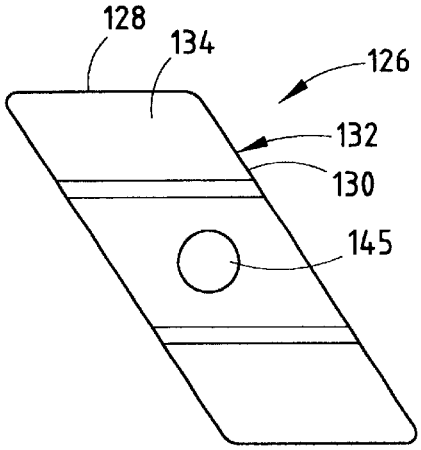
FIG. 16 is a top plan view of the T-nut.

In an alternative embodiment, the connector 59 of upper bracket assembly 54 and lower bracket assembly 56 is replaced by a T-nut 126 (FIGS. 15 and 16). Each T-nut 126 includes a pair of substantially parallel end walls 128 and a pair of substantially parallel side walls 130 that cooperate to define a substantially parallelogram-shaped body 132 that is adapted to be received within inner portion 31 of channel 28 of post 16. Each T-nut 126 also includes a first surface 134 having a recessed center portion 136 defined by a pair of inwardly-extending walls 138 extending substantially parallel to end walls 128, and a second surface 140 juxtaposed from first surface 134 and having a raised center portion 142 defined by a pair of outwardly-extending walls 144 that extend substantially parallel to end walls 128. Each T-nut 126 further includes an aperture 145 extending between first surface 134 and second surface 140.

The assembly of the overhead beam 14 (FIG. 17), upper bracket assembly 54 and lower bracket assembly 56 that includes T-nuts 126 is assembled with post 16 similarly to bracket assemblies 54 and 56 that include connectors 59 as discussed above with the most notable exception being that each T-nut 126 may be laterally placed within channel 28 of post 16 by aligning side walls 30 of each T-nut 126 with the neck portion 29 of channel 28, moving T-nuts 126 horizontally until each T-nut 126 is located within inner portion 31 of channel 28, and then by rotating each T-nut 126 within inner portion 31 of channel 28 until end walls 128 of each T-channel 126 contacts inner walls 37 of channel 28. The bolt 96 of each bracket assembly 54 and 56 extends through aperture 145 of each T-nut 126 and is threadably received by a threaded nut 146 that contacts inner walls 138 of each T-nut 126. Alternatively, aperture 145 may provid an inner thread, thereby eliminating the requirement for nut 146.

Figure 17:
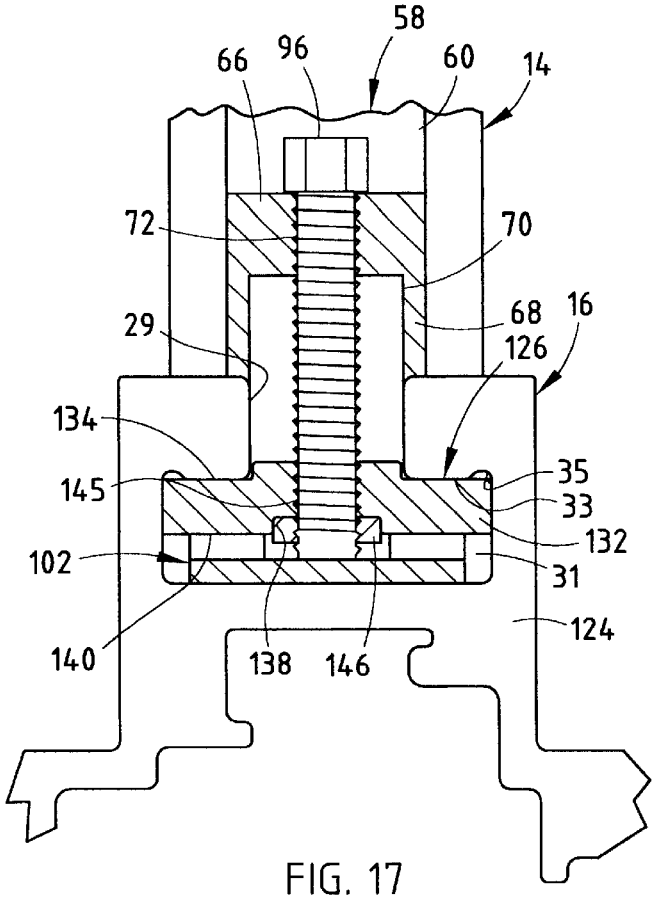
FIG. 17 is a fragmentary cross-sectional top plan view of the L-shaped bracket and the T-nut mounted in the post.

As best illustrated in FIG. 17, the positioning clip 102 is also used in conjunction with bracket assemblies 54 and 56 that include T-nuts 126 in a similar manner to that described above with respect to bracket assemblies 54 and 56 that include connectors 59, thereby assuring proper alignment between beam 14 and post 16 during assembly.

Figures 18, 19:
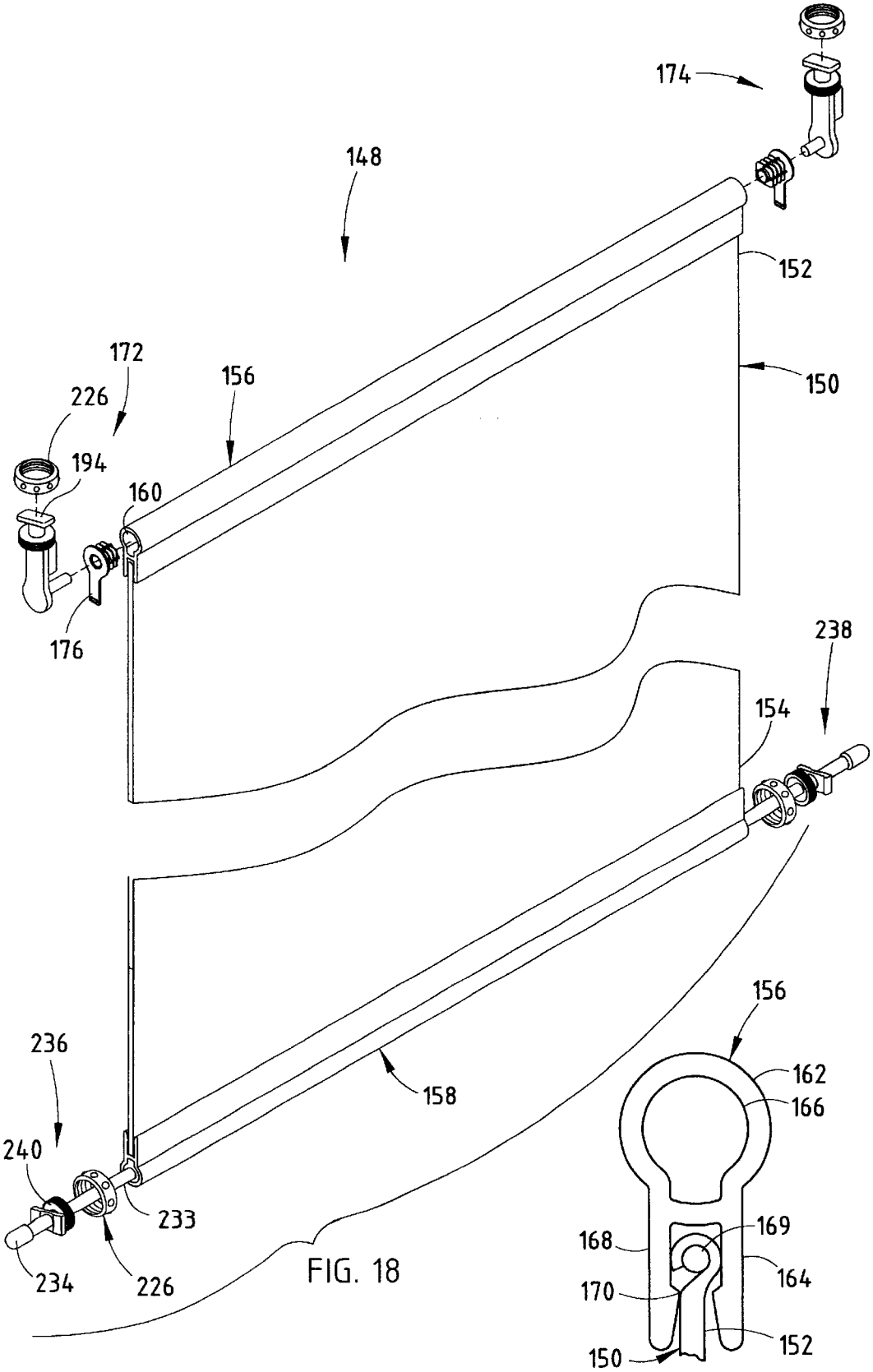
FIG. 18 is an exploded perspective view of an infill panel assembly adapted to connect with the post and beams of the furniture system.
FIG. 19 is an end view of a flexibly resilient member of the infill panel assembly.

The furniture system 10 further includes a panel assembly 148 (FIG. 18) that includes a flexible sheet member 150 having an upper end 152 and a lower end 154, an upper resilient member 156 extending laterally across panel assembly 148 and connected with upper end 152 of sheet member 150, and a lower resilient member extending laterally across panel assembly 148 and connected with lower end 154 of sheet member 150. Upper resilient member 156 and lower resilient member 158 are substantially similar except for orientation, therefore the following description of upper resilient member 156 should be considered descriptive of both upper resilient member 156 and lower resilient member 158. Upper resilient member 156 (FIG. 19) has a key hole-shaped cross-sectional configuration having open ends 160 and that is defined by a circular outer portion 162 and a rectangular inner portion 164. Circular outer portion 162 includes a longitudinally-extending circularly-shaped passage 166. Rectangular inner portion 164 is defined by a pair of legs 168 that each include a distally located inwardly-extending tooth 170. Each leg 168 is flexibly resilient, thereby allowing upper end 152 of sheet member 150 to be pressed between legs 168 of upper resilient member 156. Each tooth 170 of upper resilient member 156 engages upper end 152 of sheet member 150, thereby retaining upper end 152 of sheet member 150 between legs 168. Lower resilient member 158 engages lower end 154 of sheet member 150 in a similar manner.

Alternatively, upper end 152 of sheet member 150 is wrapped about a laterally extending rod 169, which is received between legs 168 of upper resilient member 156, thereby ensuring that upper end 152 of sheet member 150 is securely connected with upper resilient member 156. As above, lower end 154 of sheet member 152 may be connected with lower resilient member 158 in like manner.

Figure 20:
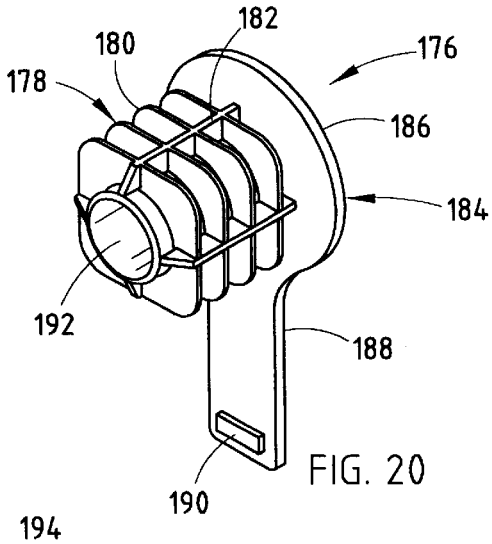
FIG. 20 is a perspective front view of a plug of the infill panel assembly.
Figure 21:
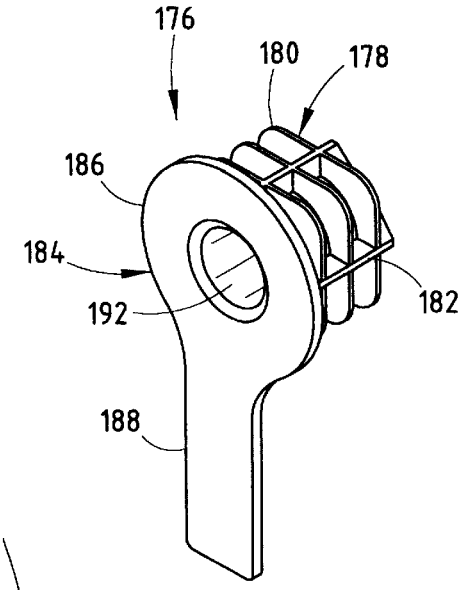
FIG. 21 is a perspective rear view of the plug of the infill panel assembly.

Panel assembly 148 also includes an upper bracket assembly that includes a first upper connector assembly 172 and a second upper connector assembly 174 juxtaposed along upper resilient member 156 and adapted to suspend panel assembly 148 from overhead beam 14. As first upper connector 172 and second upper connector assembly 174 are substantially similar, a description of first upper connector assembly 172 should be considered descriptive of upper connector assemblies 172 and 174. First upper connector assembly 172 includes an end cap 176 (FIGS. 20 and 21) that includes a ribbed stud portion 178 having a plurality of laterally extending square-shaped ribs 180 suspended and spaced apart by a plurality of outwardly-extending webs 182. Ribs 180 of stud portion 178 are flexibly resilient and frictionally engage passage 166 of upper resilient member 156 as stud portion 178 of end cap 176 is pressed within open end 160 of upper resilient member 156 as described below. End cap 176 also includes a planar section 184 having a substantially circularly-shaped upper portion 186 connected with stud portion 178, and a downwardly-extending, rectangularly-shaped lower portion 188 that includes an outwardly-extending tab 190. In assembly, upper portion 186 of planar section 84 abuts end 160 of upper resilient member 156, while lower portion 188 of planar section 184 extends downwardly along sheet member 150 and tab 190 abuts upper end 152 thereof. End cap 176 further includes an aperture 192 extending longitudinally through stud portion 178 and through planar section 184 of end cap 176.

Figure 22:
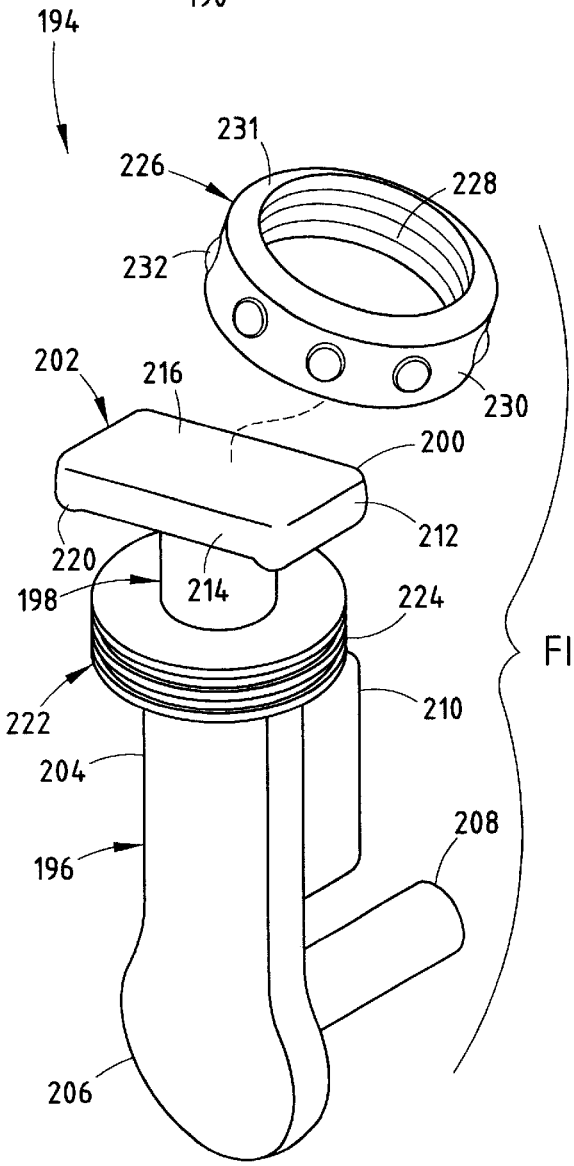
FIG. 22 is an exploded perspective view of a top connector of the infill panel assembly.
Figure 23:
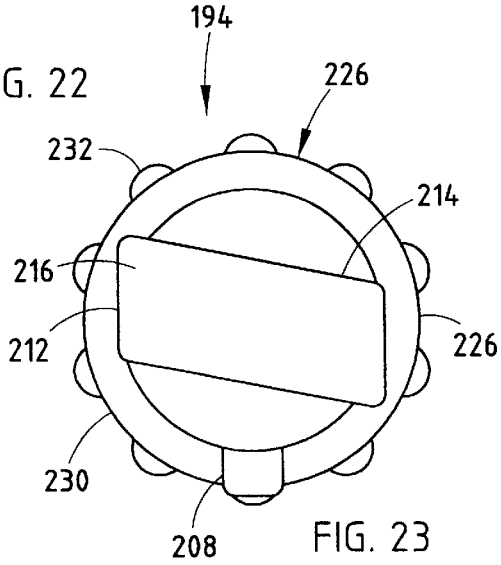
FIG. 23 is a top plan view of the top connector of the infill panel assembly.
Figure 24:
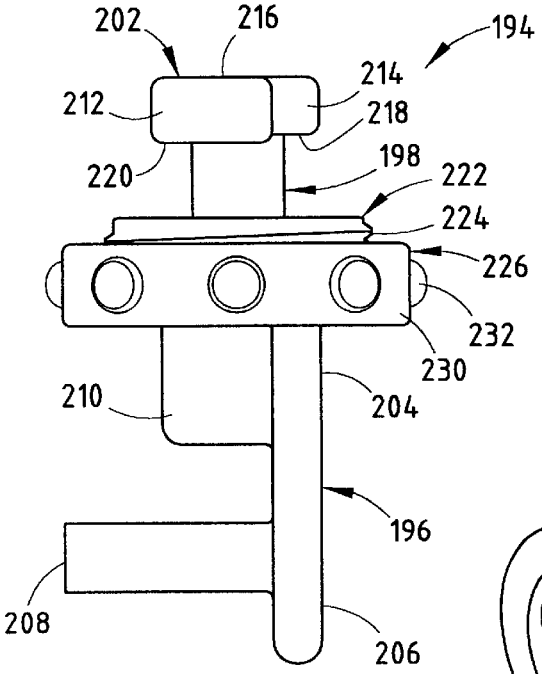
FIG. 24 is a side elevational view of the top connector of the infill panel assembly.

The first upper connector assembly 172 further includes a connector 194 (FIGS. 22–24) having a body portion 196, a cylindrically-shaped neck portion 198 extending upwardly from body portion 196, and a pair of flanges 200 cooperating to form an engagement head 202 that extends substantially orthogonally to body portion 196 and neck portion 198. Body portion 196 includes a rectangularly-shaped upper end 204 and a substantially circularly-shaped lower end 206. A cylindrically-shaped mounting stud or finger 208 is centrally-located within and extends outwardly from lower end 106 of body portion 196. A rectangular-shaped box-like spacer 210 extends outwardly from upper end 204 of body portion 196. Head 202 of connector 194 includes a pair of substantially parallel end walls 212 and a pair of substantially parallel side walls 214 that cooperate with end walls 212 to provide head 202 with a substantially parallelogram-like shape that is adapted to be mounted within channel 38 of beam 14 as described below. Head 202 also includes an outer surface 216 located away from body portion 196, and an inner surface 218 juxtaposed across head 202 from outer surface 216. Each flange 200 of head 202 includes a rounded shoulder 220 extending outwardly from inner surface 218 and adapted to be received within grooves 45 of channel 38 of beam 16 as described below.

The connector 194 also includes a disk-shaped portion 222 disposed between neck 198 and body portion 196 and extending outwardly therefrom. Disk-shaped portion 222 has a threaded outer surface 224. Connector 194 further includes a ring-shaped locking ring 226 having a centrally-located threaded aperture 228 that is adapted to threadably receive disk-shaped portion 222 therein. Locking ring 226 is partially defined by a cylindrically-shaped outer surface 230 having a plurality of outwardly-extending dimples 232 spaced circumferentially thereabout, and a radially extending contact surface 231.

In assembly, upper end 152 of sheet member 150 is pressed between flexible legs 168 of upper resilient member 156. Stud portion 178 of each end cap 176 is pressed within passage 166 at ends 160 of upper resilient member 156 such that ribs 180 of each end cap 176 are frictionally held within the passage 166 and upper portion 186 of planar section 184 of each end cap 176 abuts an end 160 of upper resilient member 156. The connector 194 of connector assemblies 172 and 174 are connected with lower channel 38 of beam 16 by aligning side walls 214 of head 202 of each connector 194 with channel 38, moving each connector 194 vertically until neck portion 198 of each connector 194 is horizontally aligned with neck portion 39 of channel 38 and head 202 is located within inner portion 41 of channel 38, and rotating each connector 194 until end walls 212 of head 202 of each connector 194 contacts inner walls 47 of channel 38. The locking ring 226 of each connector 194 is then threaded along disk-shaped portion 222 until contact surface 231 of each ring 226 abuts bottom face 32 of beam 16, thereby forcing inner surface 218 and shoulder **220*a* of each connector 194 into frictional engagement with inner channel wall 43 and grooves 45 of channel 38**, respectively.

Figure 25:
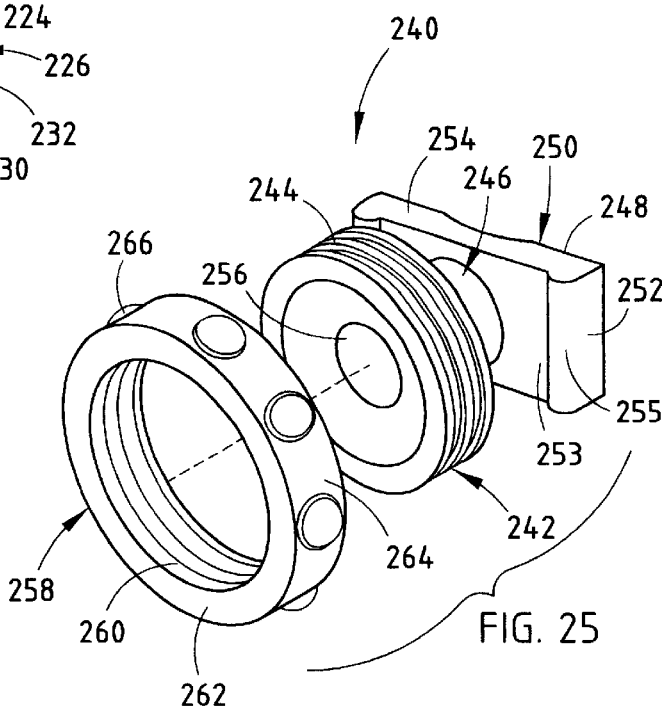
FIG. 25 is an exploded rear perspective view of a bottom connector of the infill panel assembly.
Figure 26:
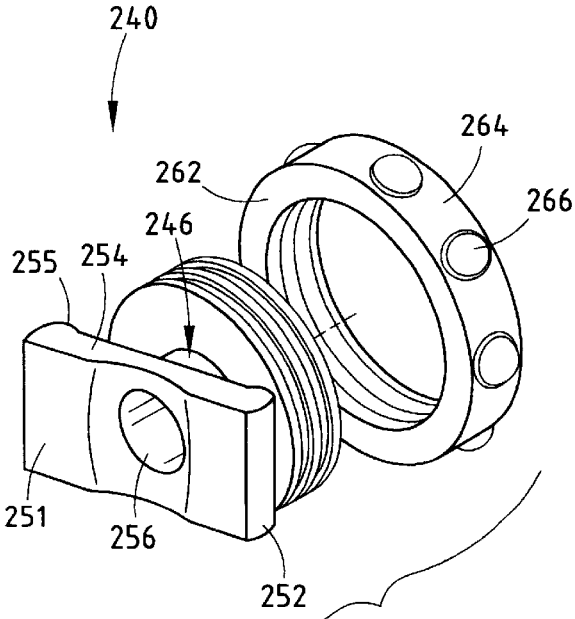
FIG. 26 is a front perspective view of the bottom connector of the infill panel assembly.
Figure 27:
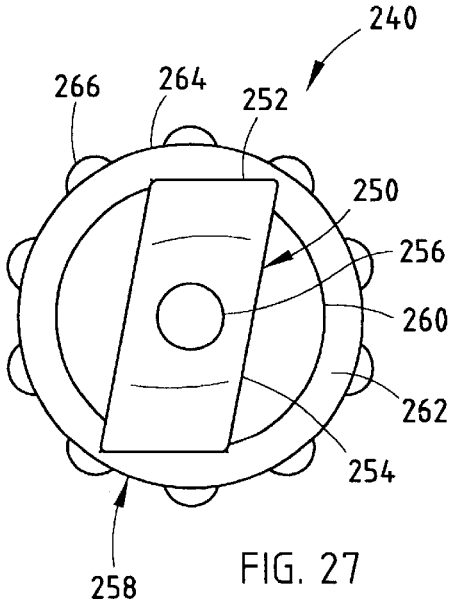
FIG. 27 is an end view of the bottom connector of the infill panel assembly.

The lower bracket assembly of panel assembly 148 (FIG. 18) includes an elastically-deformable cord 233 having a cap member 234 fixedly attached to each end thereof, a first lower connector assembly 236 and a second lower connector assembly 238. Alternatively, each cap member 234 may be replaced by a knot within cord 233. As first lower connector assembly 236 and second lower connector assembly 238 are substantially similar, the description of first lower connector assembly 236 should be considered descriptive of first lower connector assembly 236 and second lower connector assembly 238. First lower connector assembly 236 includes a T-shaped connector 240 (FIGS. 25–27). Connector 240 includes a cylindrically-shaped inner portion 242 having a threaded outer surface 244, a cylindrically-shaped neck portion 246 extending outwardly from inner portion 242, and a pair of flanges 248 that cooperate to form a head 250 that extends substantially orthogonal to neck portion 246 and forms a substantial T-shape therewith. Head 250 includes a pair of substantially parallel end walls 252 and a pair of substantially parallel side walls 254 that cooperate with end walls 252 to provide head 250 a substantially parallelogram-type shape that is mountable within channel 28 of post 16. Head 250 also includes an outer surface 251 located away from neck portion 246, an inner surface 253 juxtaposed across head 250 from outer surface 251, and a pair of rounded shoulders 255 extending outwardly from inner surface 253 and extending across the width of head 250 defined between side walls 254. Shoulder 255 are adapted to be received within grooves 35 of channel 28 as described below. Connector 240 also includes an aperture 256 extending through inner portion 242, neck portion 246 and head 250. Connector 240 further includes a threadably attachable, ring-shaped locking ring 258 having a centrally-located threaded aperture 260 that threadably receives inner portion 242 of connector 240 therein. Locking ring 248 also includes a radially extending contact surface 262 and a circumferentially extending outer surface 264 having a plurality of outwardly-extending circumferentially spaced dimples 266.

In assembly, lower end 254 of sheet member 250 is pressed between flexible legs 268 of lower resilient member 258, and cord 233 is placed within passage 266 of lower resilient member 258. Connector 240 of each connector assembly 236 and 238 is then connected with cord 233 by threading the ends of cord 233 through aperture 256 of connector 240 and connecting end caps 234 to the ends of cord 233, thereby preventing each connector 240 from being removed from about cord 233. First lower connector assembly 236 is connected with a first post 16 by aligning side walls 254 of head 250 of connector 240 with neck portion 29 of channel 28, moving the connector 240 horizontally until head 250 of connector 240 is located within inner portion 31 of channel 28 and neck portion 246 of connector 240 is laterally aligned with neck 29 of channel 28, and rotating connector 240 until end walls 252 of connector 240 contact inner wall 37 of channel 28. Locking ring 258 is then threaded upon inner portion 242 of connector 240 until contact surface 262 of locking ring 258 abuts end face 26 of flange 24 of post 16, thereby drawing inner surface 253 and shoulders 255 of head 250 into frictional engagement with inner channel surface 33 and grooves 35 of channel 28, respectively. Second lower connector assembly 238 is connected with a channel 28 of a post 16 extending along an opposite side of panel assembly 148 in similar fashion to that of first lower connector assembly 236. Upper connector assemblies 172 and 174, lower connector assemblies 236 and 238 and elastically-deformable cord 233 cooperate to maintain flexible sheet member 150 in a substantially planar state.

Figure 28:
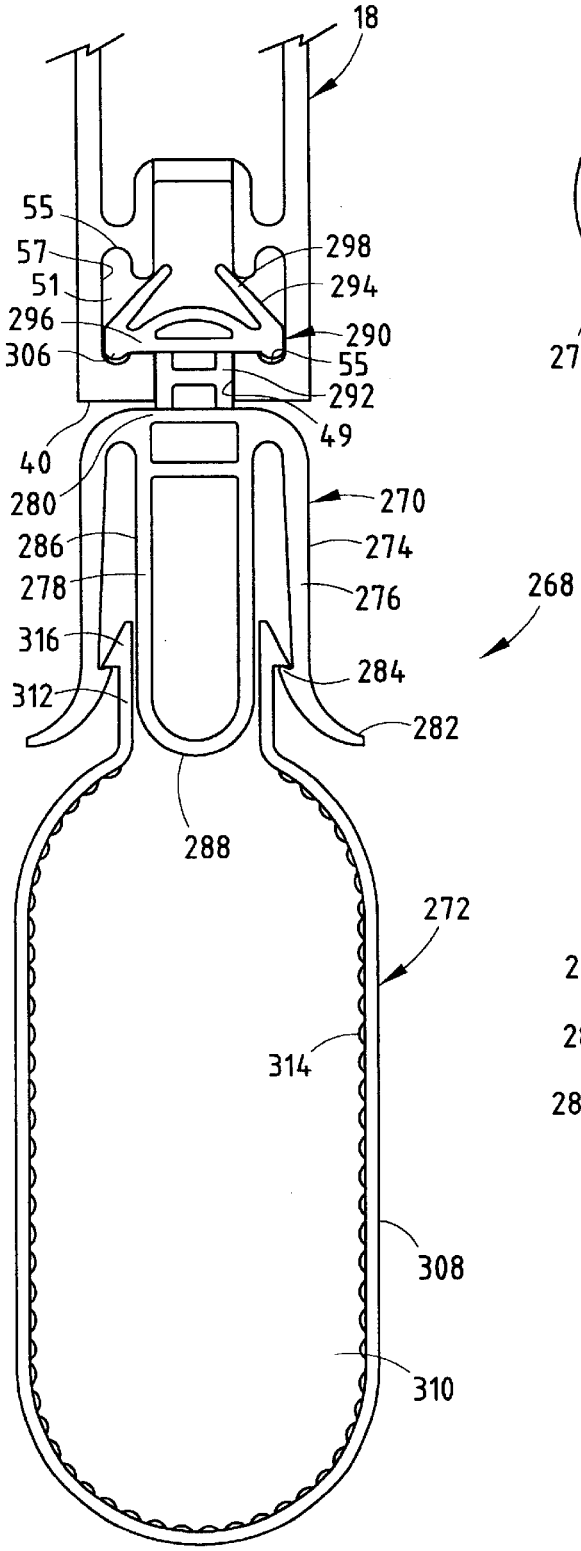
FIG. 28 is an end view of a horizontally-extending wire manager connected with the horizontally-extending beam.
Figure 30:
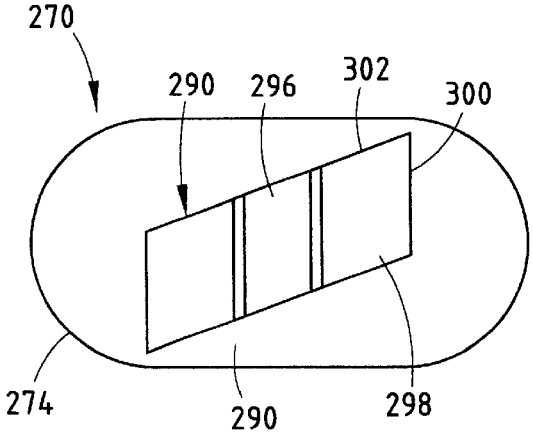
FIG. 30 is a top plan view of the engagement clip of the horizontally-extending wire manager.
Figure 29:
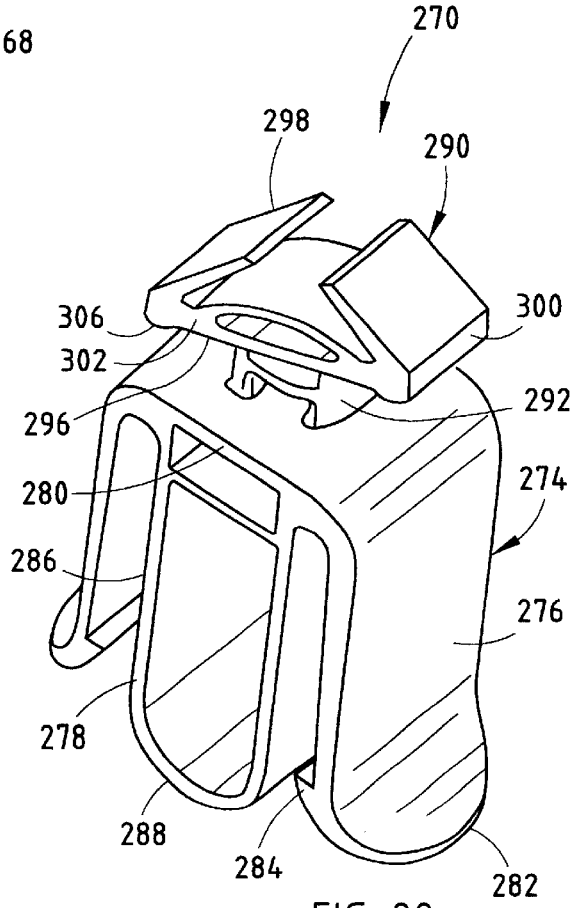
FIG. 29 is a perspective view of an engagement clip of the horizontally-extending wire manager.

The furniture system 10 further includes a horizontally-extending wire manager 268 (FIGS. 1 and 28) suspended from mid-height beam 18 and including a plurality of engagement clips 270 and a longitudinally-extending utility tube 272. Each engagement clip 270 (FIGS. 29 and 30) includes an M-shaped body 274 having a pair of outer legs 276 and a U-shaped inner leg 278 each extending downwardly from a planar base portion 280. Each leg 276 has an outwardly-curved end and an inwardly and laterally extending tooth 284. Inner leg 278 includes a pair of downwardly-extending side surfaces 286 that are connected at a lower portion thereof by a U-shaped bottom surface 288. Clip 270 further includes a connector 290 integrally molded with and extending upwardly from base portion 280. Connector 290 includes a neck portion 292 that extends outwardly from base portion 280, and a head 294 connected to neck portion 292 at an opposite end from base portion 280. Head 294 includes a planar base 296, a pair of upwardly extending, flexibly resilient legs 298 that each angle inwardly to form a substantially triangular shape with base 296. Head 294 of clip 270 includes a pair of end walls 300 and a pair of side walls 302 that cooperate with end walls 300 to provide 294 with a substantially parallelogram-type shape that is receivable within channel 48 of beam 18. Head 294 includes lower surface 304 and a pair of rounded shoulders 306 extending downwardly from lower surface 304 and laterally across the width of head 296 defined by side walls 302. Shoulders 306 are juxtaposed across base 296 of head 294 and are adapted to be received within grooves 55 of channel 48 of beam 18 as described below.

The utility tube 72 of wire manager 68 includes a body portion 308 having a substantially oval-shaped cross-sectional geometry defining a central passage 310 therein, and terminates in a pair of upwardly extending legs 312 extending longitudinally along an upper portion of body portion 308. Body portion 308 is provided with a ribbed inner surface 314. Each leg 312 includes an outwardly-extending tooth 316 extending longitudinally along utility tube 272. Utility tube 272 is preferably extruded from a translucent plastic, however other materials and processes may be substituted therefor.

In assembly, a plurality of clips 270 are connected with beam 18 and utility tube 272 is then connected therewith. Specifically, each clip 270 is connected with beam 18 by aligning side walls 302 of head 294 with channel 48 of beam 18, moving clip 270 vertically until head 294 of clip 270 is located within inner portion 51 of channel 48 and neck portion 292 of clip 270 is vertically aligned with neck 49 of channel 48, and rotating clip 270 until end walls 300 of head 294 contact inner walls 57 of channel 48. Utility tube 272 is then connected with clips 270 by pressing legs 312 of utility tube 272 in between outer legs 276 and inner leg 278 of each clip 270, thereby causing outer legs 276 to flex outwardly and teeth 316 of utility tube 272 to engage teeth 284 of each clip 270. Curved ends 282 of outer legs 276 of clips 270 are configured to provide a gap between outer legs 276 and utility tube 272, thereby providing a finger space therebetween and allowing an operator to easily disconnect utility tube 272 from clips 280 by flexing end 282 of each outer leg 267 outwardly and disengaging utility tube 272 from each clip 270.

Figure 31:
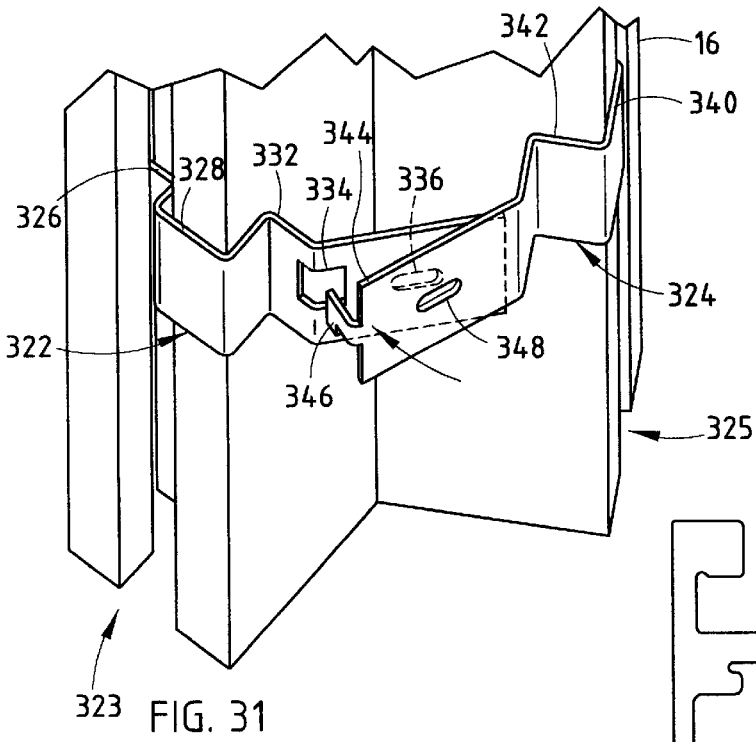
FIG. 31 is a perspective view of a first bracket and a second bracket of a vertically extending wire manager engaged with a Y-shaped vertically extending post.
Figure 32:
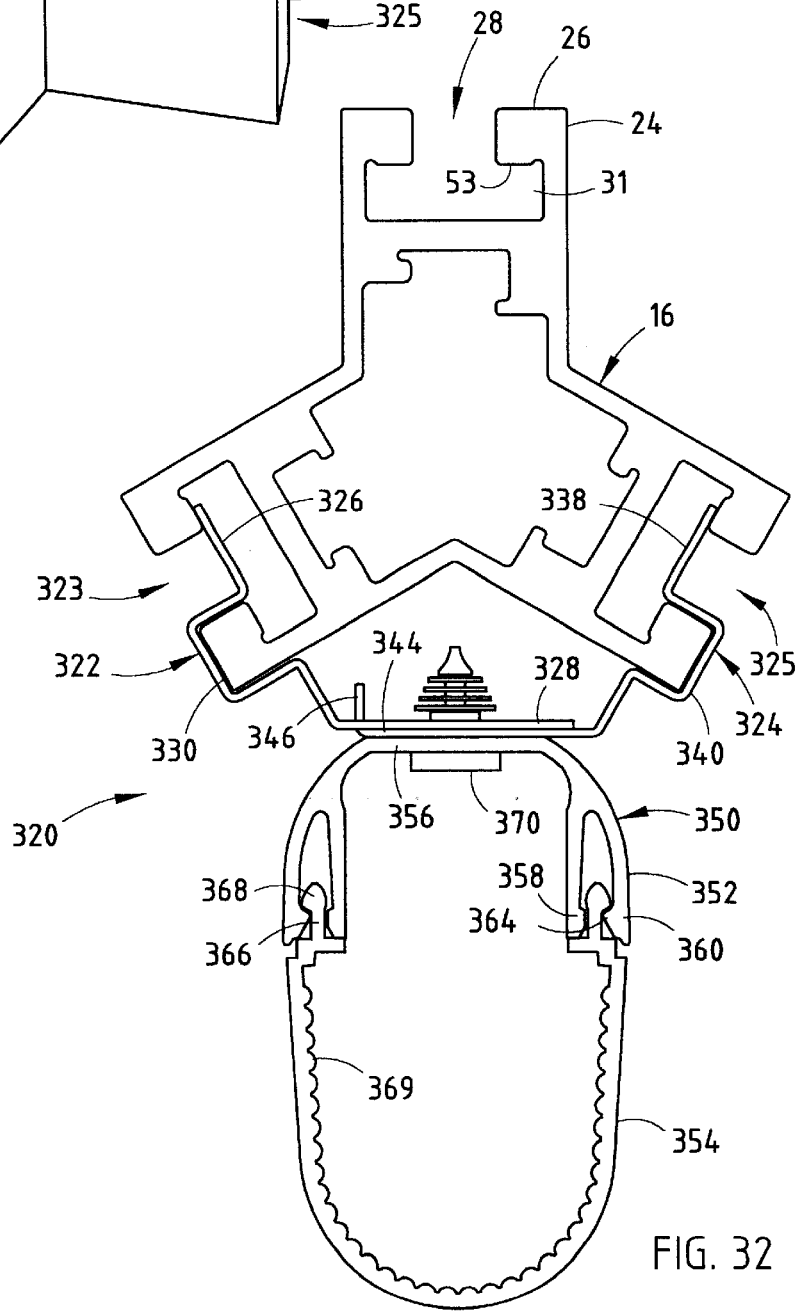
FIG. 32 is an end view of the vertical wire manager coupled with the Y-shaped post.

The furniture system 10 further includes a vertically extending wire manager 320 (FIGS. 1, 31 and 32) that extends vertically along and is connected with a post 16. Wire manger 320 includes a first bracket 322 engaged with a first channel 323 of post 16, and second bracket 324 engaged with a second channel 325 of post 16. Channels 323 and 325 are identical to channel 28 as previously described, and the numerical designator has been included herewith for purposes of description only. In the present example, post 16 has a Y-shaped cross-sectional geometry, although a similar arrangement may be utilized with posts 16 having a Y-shape. First bracket 322 includes a first L-shaped end 326 that is received within inner portion 31 of channel 325, and a second end 328 adapted to abut to a mid-portion of second bracket 324 as described below. First bracket 322 also includes a hat-shaped portion 330 spaced along the length thereof, integrally formed with L-shaped first end 26, and that extends about end face 26 of flange 24 of post 16, and an inwardly-extending V-shaped portion 332 spaced along the length thereof and integrally formed with hat-shaped portion 330. First bracket 322 further includes a square-shaped aperture 334 spaced along a length thereof and integrally shaped within V-shaped portion 332, and an oval-shaped aperture 336 located along the length thereof. Second bracket 324 includes a first end 338, similarly shaped to first end 326 of first bracket 322, a hat-shaped portion 340 similarly shaped to hat-shaped portion 330 of first bracket 322, and a V-shaped portion 342 similar in shape to V-shaped portion 332 at first bracket 322. Second bracket 324 also includes a second end 344 that includes an inwardly and downwardly facing hook-shaped fastener 346. Second bracket 324 further includes an oval-shaped aperture 348 located along the length thereof, and concentrically located with aperture 336 of first bracket 322 when wire manager 320 is mounted on post 16 as described below.

Figure 33:
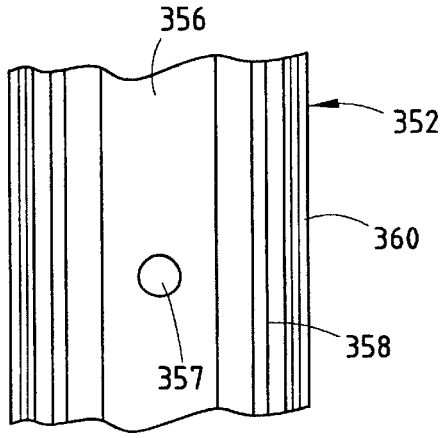
FIG. 33 is a partial front elevational view of a first portion of a utility tube of the vertical wire manager.

The wire manager 320 further includes a two-piece utility tube 350 that includes an elongated U-shaped first portion 352 and an elongated U-shaped second portion 354 that is snappably engaged with first portion 352. First portion 352 includes a planar base 356 and two pairs of outwardly-extending fingers each including an inner finger 358 and an outer finger 360. Inner finger 358 includes a longitudinally-extending tooth or barb 362, while finger 360 includes a longitudinally-extending engagement tooth or barb 364 that cooperates with tooth 362 to retain second portion 354 of utility tube 350 as inner finger 358 and outer finger 360 are each flexibly resilient. Base 356 of first portion 352 includes a plurality of oval-shaped apertures 357 (FIG. 33) spaced along the length thereof, concentrically located with apertures 336 and 348 of first bracket 322 and second bracket 324, respectively, when wire manager is in an assembled state and adapted to receive mechanical fasteners therein as described below. Second portion 354 includes a pair of tabs 366 extending longitudinally along terminating edges of the U-shaped second portion. Each tab 366 includes an enlarged head 368. Second portion 354 is provided with a ribbed interior surface 36, and is preferably constructed from an extruded translucent plastic, although other suitable materials may be utilized.

In assembly, first end 326 of first bracket 322 is inserted into channel 323, first end 338 of second bracket 324 is inserted into channel 325, and second end 344 of second bracket 324 is pressed inwardly until hook 346 of second bracket 324 is received within aperture 334 of first bracket 322, thereby connecting second bracket 324 with first bracket 322. As second end 344 of second bracket 324 is pressed inwardly, second end 328 contacts second bracket 324 at a point along the length thereof and first and second brackets 322 and 324 are forced to longitudinally flex, thereby forcing a frictional engagement of first and second brackets 322 and 324 with post 16. First portion 352 of utility tube 350 is then positioned such that apertures 357 of first portion 352 concentrically align with corresponding apertures 336 and 348, and a mechanical fastener 370 is extended through apertures 357, 336 and 348, thereby fastening first portion 352 of utility tube 350 with first and second brackets 322 and 324. Although the mechanical fastener 370 in the illustrated example includes a Christmas tree-type fastener, other fasteners suitable for such application may be utilized. Second portion 354 of utility tube 350 is then snappably connected with first portion 352 by snappingly engaging tabs 366 between corresponding pairs of fingers 358 and 360.

Figure 34A:
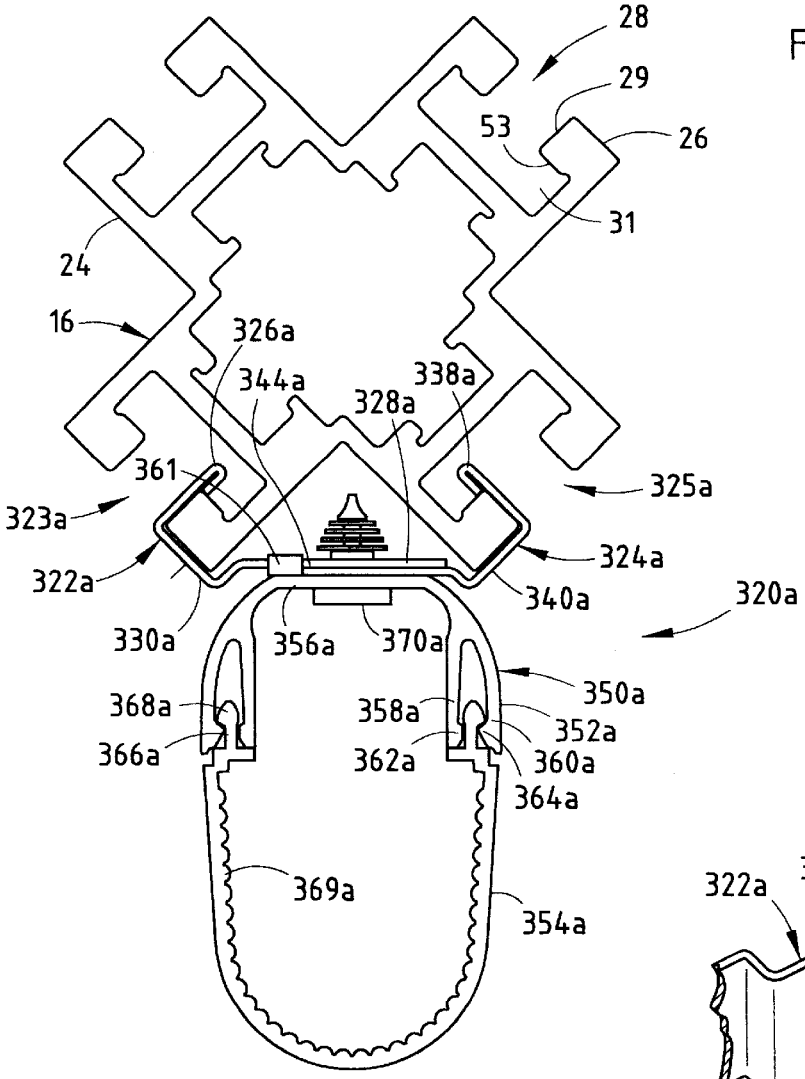
FIG. 34A is an end view of an alternative embodiment of the vertically extending wire manager connected with a post having an X-shaped cross-sectional geometry.
Figure 34B:
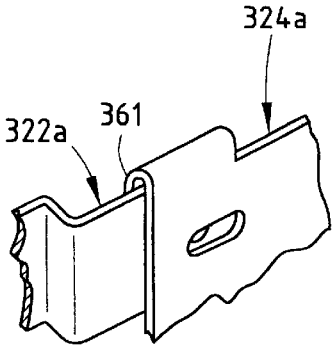
FIG. 34B is an enlarged partial perspective view of a connector of the alternative embodiment of the vertical wire manager.

The reference numeral 320*a* (FIG. 34A) generally designates an alternative embodiment of the vertically oriented wire manager. Since wire manager 320*a* is similar to the previously described wire manager 320, similar parts appearing in FIGS. 32 and 34 respectively are represented by the same, corresponding reference numeral except for the suffix "a" in the numerals of the latter. Wire manager 320*a* is similar in construction and assembly to wire manager 320 described above with the most notable exception being the configuration of first end 326*a* and 338*a* of brackets 322*a* and 324*a,* respectively. Specifically, first end 326*a* and 338*a* are hook-shaped rather than L-shaped and are configured to wrap about neck portion 29 of channel 323*a* and 325*a* and abut inner edge 53 thereof. Further, aperture 334 and hook 336 of wire manager 320 is replaced by a hook-shaped connector 361 (FIG. 34B) that loops over the top of first bracket 322*a*.

Figure 35:
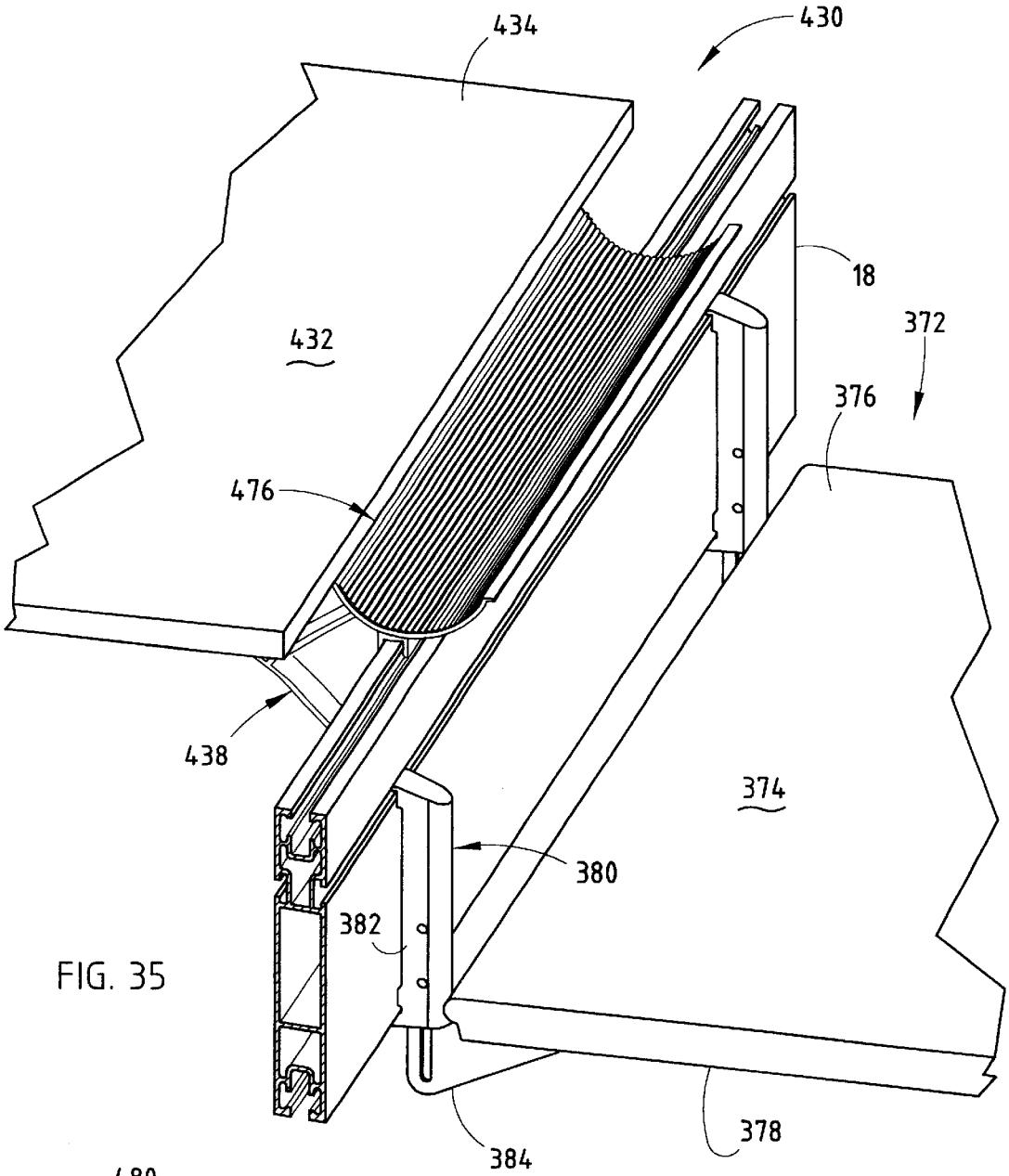
FIG. 35 is a perspective view of a vertically adjustable worksurface assembly and a transactional surface assembly each supported from a horizontally-extending mid-height beam.

The furniture system 10 further includes a vertically adjustable worksurface assembly 372 (FIG. 35) that includes a planar worksurface 374 having a top surface 376 and a bottom surface 378, and a pair of supporting bracket assemblies 380 having a clamp-on bracket 382 connected with mid-height beam 18, and a vertically adjustable jaw 384.

Figure 36B:
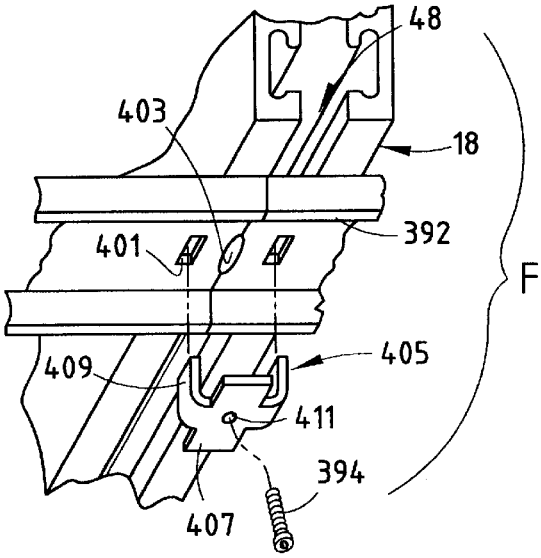
FIG. 36B is a partial bottom perspective view of an alternative embodiment of the supporting bracket.
Figure 36:
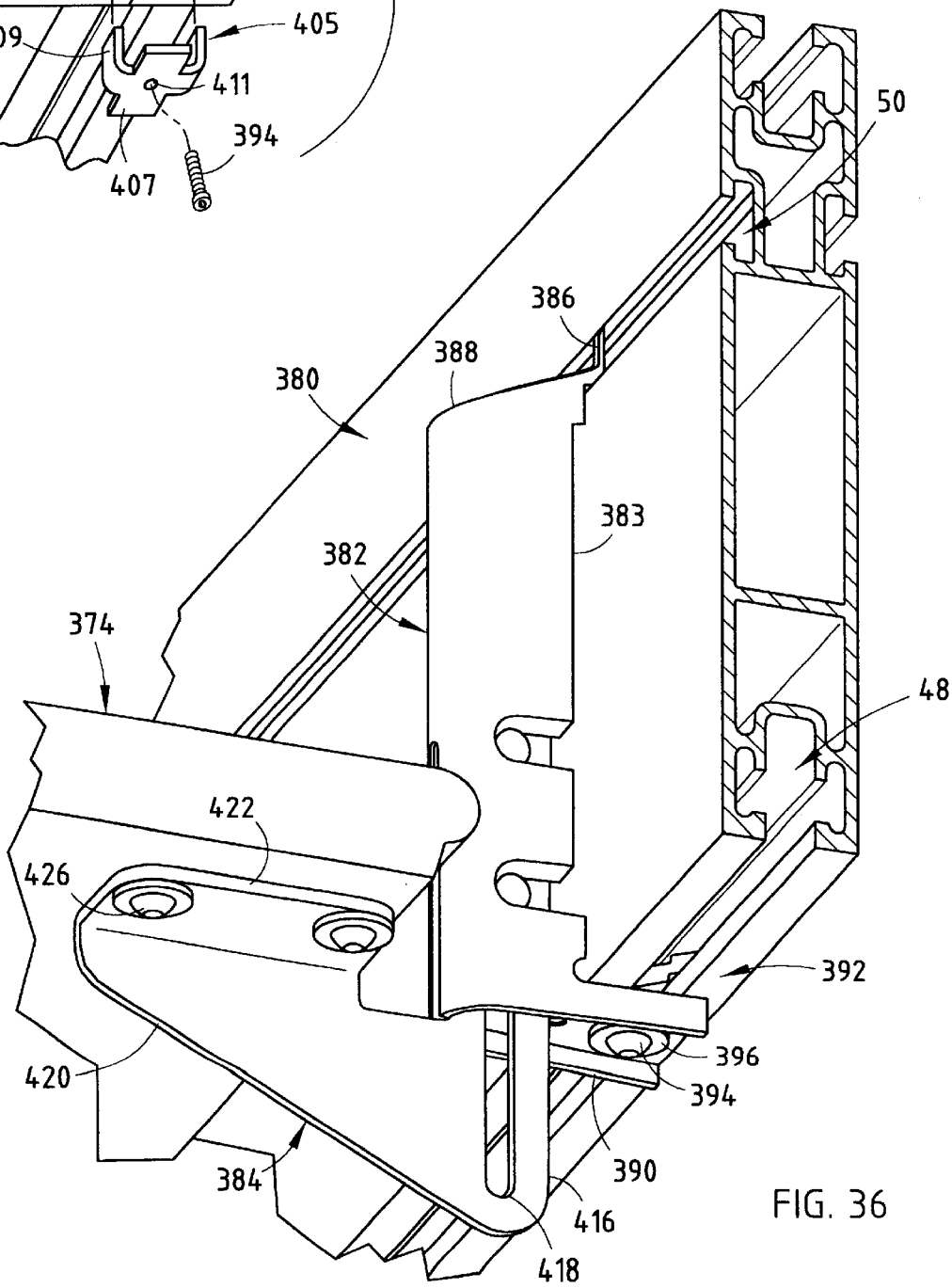
FIG. 36 is a fragmentary perspective view of a supporting bracket and a worksurface of the worksurface assembly mounted on the horizontally-extending mid-height beam.
Figure 37:
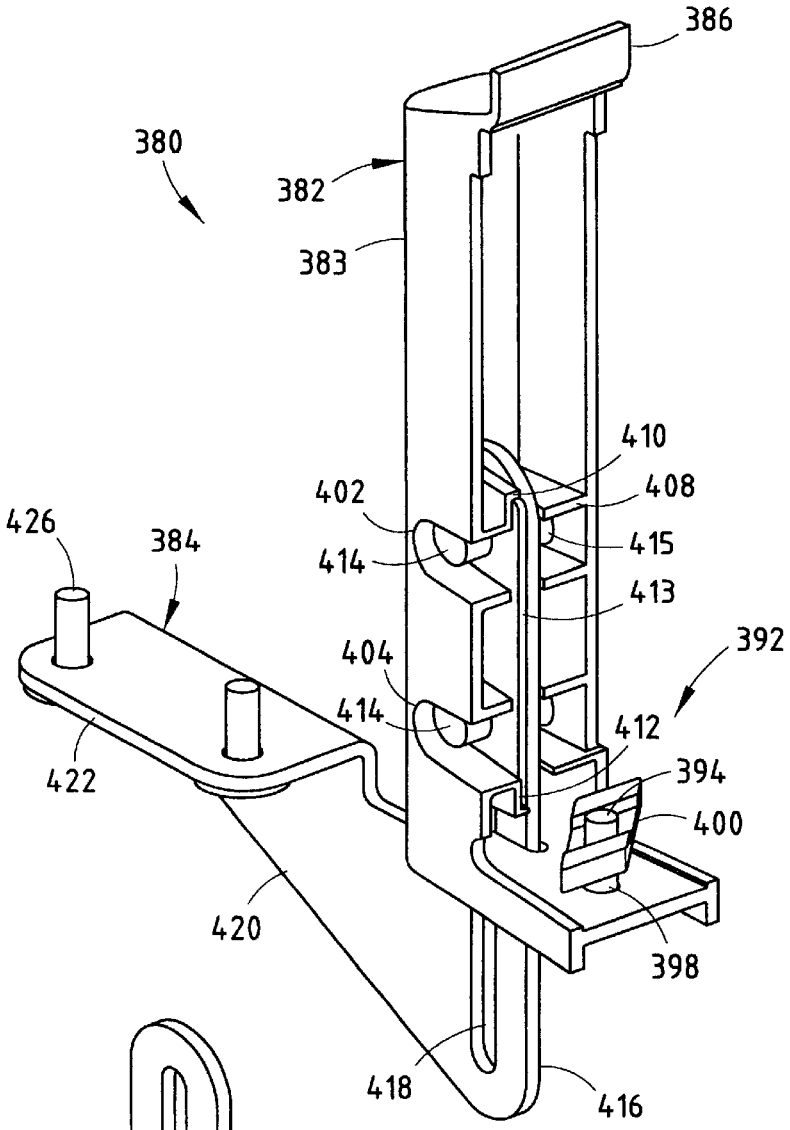
FIG. 37 is a perspective view of the supporting bracket of the worksurface assembly.

Each clamp-on bracket 382 (FIGS. 36 and 37) of bracket assembly 380 includes a body 383 having a substantially U-shaped cross-sectional geometry and includes an L-shaped engagement tab 386 located at a first end 388 thereof, and a downwardly opening C-shaped support leg 390 extending substantially orthogonal to body 383 and supporting a connector assembly 392 therefrom. Connector assembly 392 includes a T-nut 400 similar in configuration to T-nut 126 as described above, and a threaded machine screw 394 that extends upwardly through a washer 396 and an aperture 398 extending vertically through leg 390 of clamp-on bracket 382, and that is threadably received within T-nut 400. Body 383 of each clamp-on bracket 382 includes a pair of spaced apart U-shaped apertures 402 and 404, and a plurality of inwardly-extending alignment walls 408 aligned with apertures 402 and 404. The outwardly-most located alignment walls 408 include inwardly facing, L-shaped stops 410 and 412. Each clamp-on bracket 382 further includes a locking plate 413 that includes a pair of apertures (not shown) extending therethrough. Each clamp-on bracket 382 further includes a pair of locking screws 414 extending through the apertures of locking plate 414, channel 418 of bracket 416 and threadably received within threaded bosses 415 integrally formed with associated bracket 382.

Figure 38:
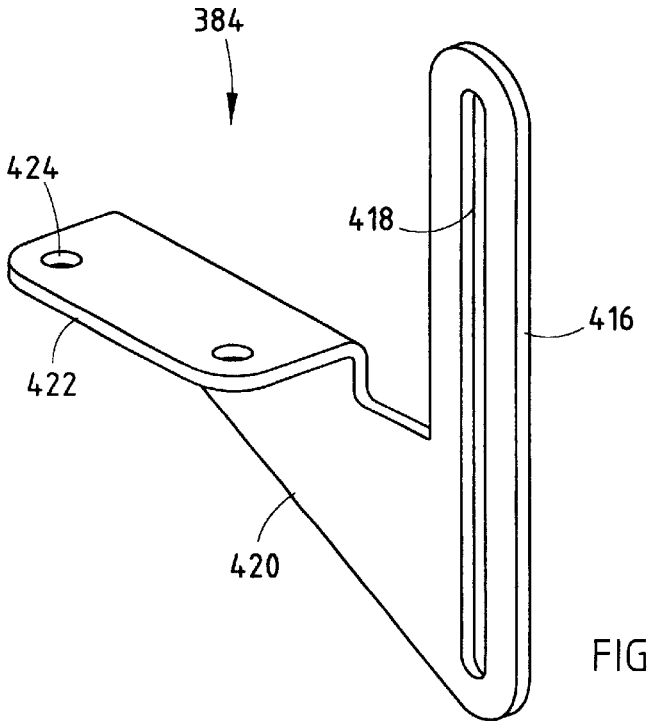
FIG. 38 is a perspective view of a vertically adjustable jaw of the supporting bracket of the worksurface assembly.

Clamp-on bracket 383 also includes a jaw 384 (FIG. 38) that includes a planar, oval-shaped telescoping arm 416 having a longitudinally-extending, oval-shaped slot 418 centrally-located therein. A triangularly-shaped support arm 420 extends outwardly and coplanar with arm 416. Jaw 384 further includes a horizontally-extending support flange 422 integrally formed with arm 420 and including a pair of apertures 424 extending vertically therethrough and receiving mechanical fasteners such as bolts 426 therethrough that connect worksurface 374 with each bracket assembly 380.

In assembly, worksurface 374 is operably connected to jaw 384 of each bracket assembly 380 via bolts 426. Engagement tab 386 of each clamp-on bracket 382 is then mounted within channel 50 of beam 18, while connector assembly 394 is mounted within channel 48 of beam 18. Specifically, the T-nut 400 of connector assembly 396 is mounted within channel 48 by aligning T-nut 400 with channel 48, inserting T-nut 400 into interior portion 51 of channel 48, and rotating T-nut 400 until the end walls thereof contact interior walls 57 of channel 48, in similar fashion to T-nut 126 of connector assembly 52 as described above.

Figure 39:
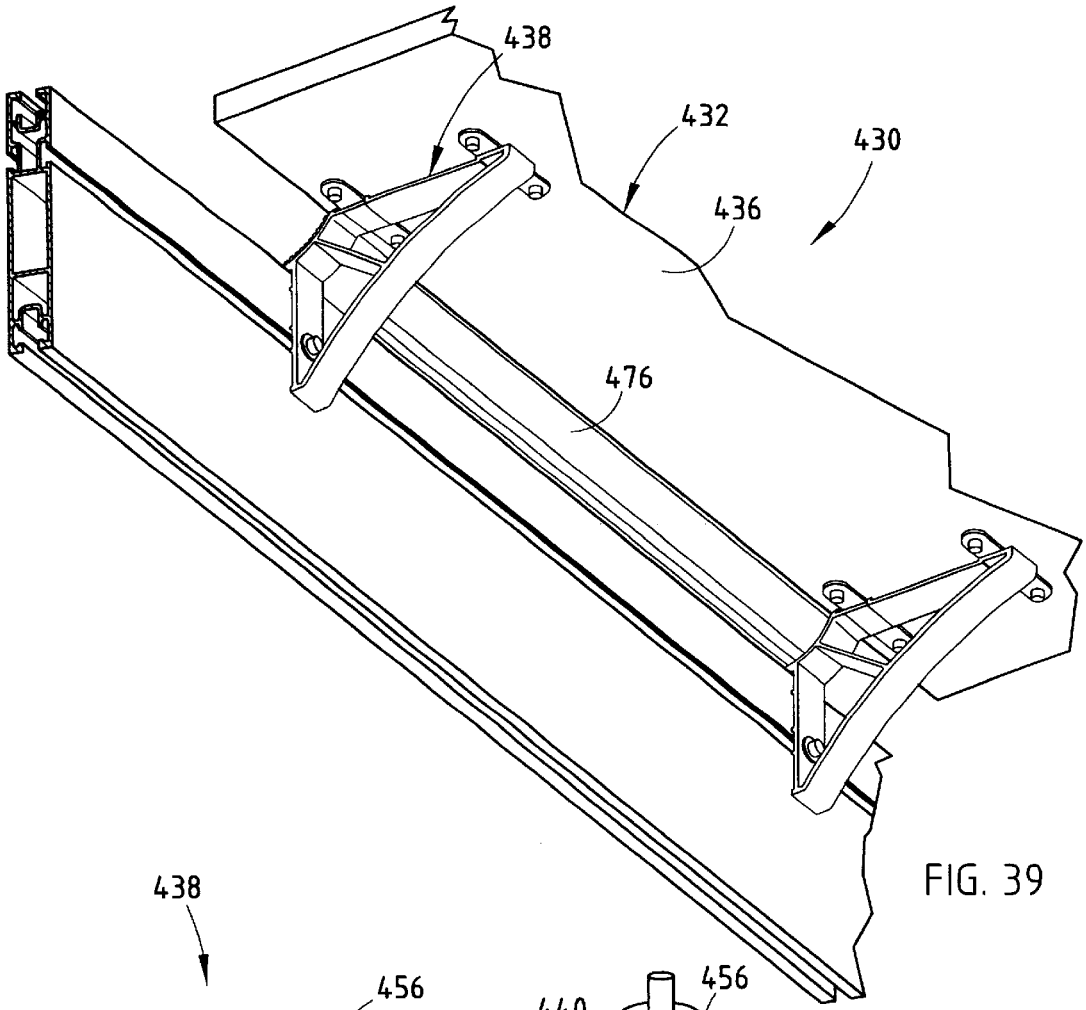
FIG. 39 is a fragmentary bottom perspective view of the transactional surface assembly.
Figure 40:
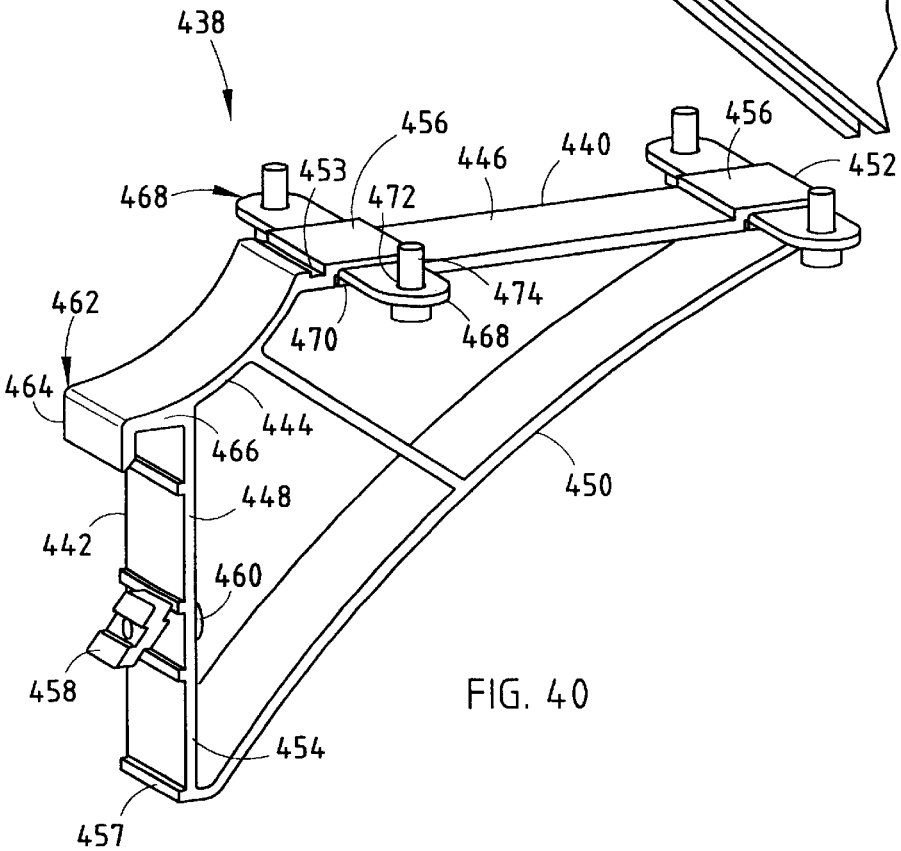
FIG. 40 is a perspective view of a supporting bracket of the transactional surface assembly.

The furniture system 10 further includes a transactional worksurface assembly 430 (FIGS. 35 and 39) that includes a transactional worksurface 432 having a top surface 434 and bottom surface 436, and a pair of supporting brackets 438 that connect with top channel 46 and side channel 50 of mid-height beam 18. Each bracket 438 (FIG. 40) includes a horizontally-extending portion 440, a vertically extending portion 442, an arcuately-shaped upwardly-facing structural member 444 extending between and intricately formed with a proximal end 446 of horizontal portion 440 and an upper end 448 of horizontal portion 440, and an arcuately-shaped, downwardly facing support member 450 extending between and integrally formed with a distal end 452 of horizontal portion 440 and a lower end 454 of vertical portion 442. Horizontal portion 440 of each bracket 438 includes a pair of upwardly extending hat-shaped shoulders 456 integrally formed within portion 440 proximate proximal end 446 and distal end 452, respectively. Horizontal portion 440 further includes a lateral extending groove 453 located at proximate end 446. Vertical portion 442 includes a plurality of rearwardly extending ribs 457 adapted to contact side wall 44 of beam 18. A T-nut 458 similar to T-nut 126 described above is connected to vertical portion 442 via a mechanical fastener 460. Structural member 444 terminates in a downwardly-extending hook 462 that extends rearwardly from portion 442 and includes a vertically oriented tab 464 and a horizontally-extending support portion 466.

Figure 41:
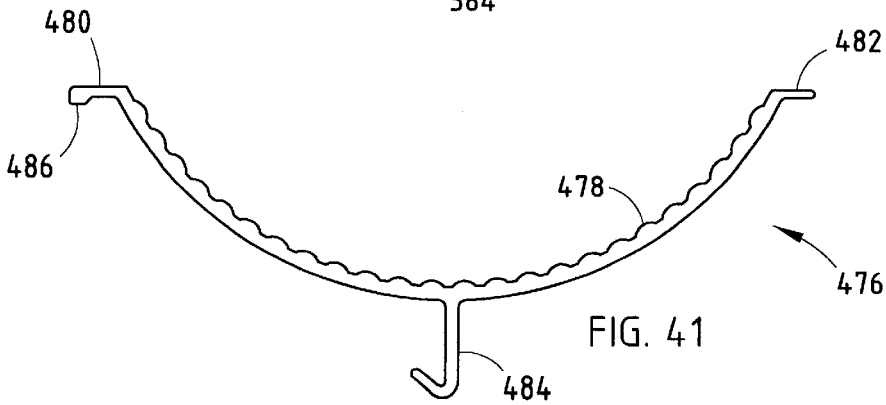
FIG. 41 is an end view of a tray of the transactional surface assembly.

Worksurface assembly 430 further includes an elongated tray 476 (FIG. 41) having a ribbed upper surface 378, a pair of flanges 480 and 482 extending outwardly from terminating edges of tray 476 and longitudinally therealong, and a downwardly-extending hook 484 extending longitudinally along tray 476. Flange 480 includes a longitudinally-extending tab 486 at a distal end thereof. Tray 476 is preferably constructed of a translucent plastic, however other suitable materials may be utilized therefore.

In assembly, horizontal portion 440 of each bracket 438 is operably connected with bottom surface 436 of worksurface 432 by a pair of connector brackets 468 each having a hat-shaped shoulder 470 that mates with shoulders 456 of horizontal portion 440, and a pair of apertures 472 that receive mechanical fasteners such as bolts 474 therein which fasten to worksurface 432. Worksurface assembly 430 is assembled such that tab 486 of tray 476 is trapped between bracket 438 and worksurface 432 with groove 453 of horizontal portion 440. Hook 462 is then mounted within top channel 46 of beam 18 and T-nut 458 is mounted within side channel 50 of beam 18 similar to T-nut 400 of worksurface 372 within bottom channel 48 of beam 18. Hook 484 of tray 476 is also located within upper channel 46 of beam 18.

In an alternative embodiment, leg 390 of each hang-on bracket 382 is shortened to allow for back-to-back placement of a pair of worksurface assemblies 372 along beam 18. Specifically, leg 382 is shortened and includes a laterally extending oval-shaped aperture 401 and a semicircular aperture 403 communicating with the end thereof. A hat-shaped bracket 405 has a planar body portion 407 and a pair of orthogonally extending flanges 409 is used to tie leg 309 of each hang-on bracket 382 together by inserting flanges 409 into apertures 401, and then retaining bracket 405 on place via bolt 394 that extends through an aperture 411 centrally-located within body portion 407 of bracket 405 and apertures 403 of the associated brackets 382.

Figure 42:
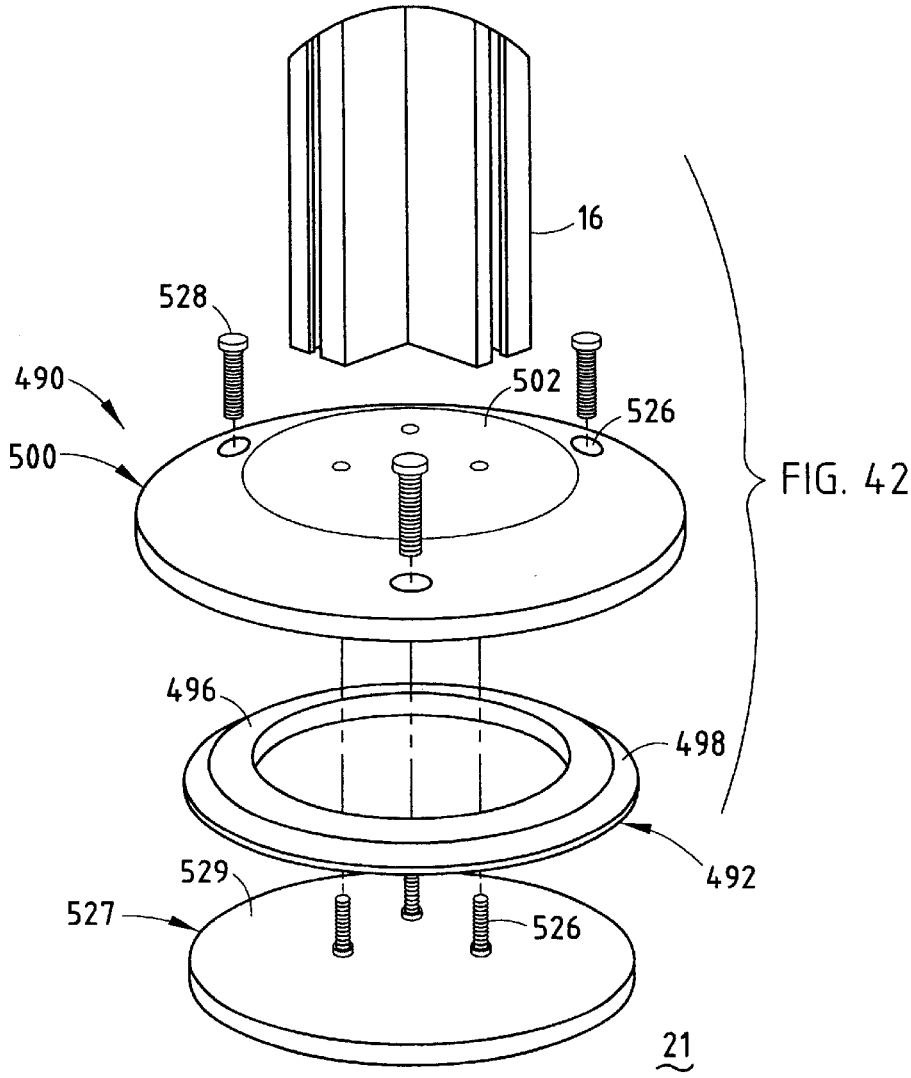
FIG. 42 is an exploded perspective view of a swivel support assembly and a vertical post.
Figure 43:
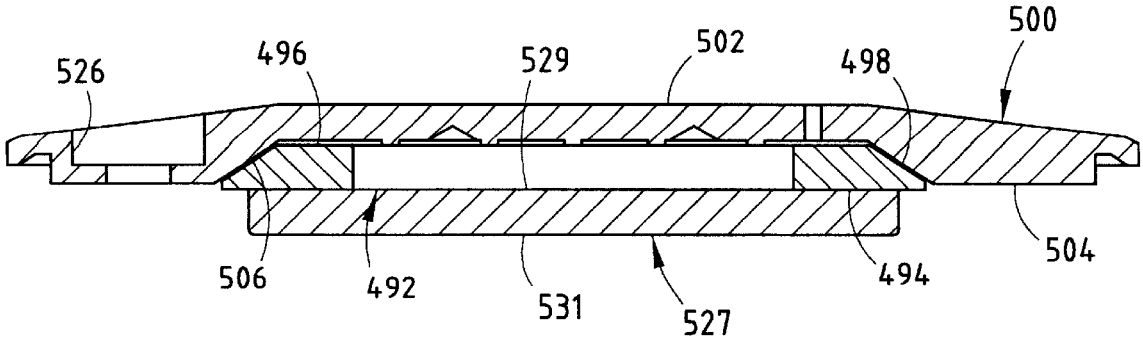
FIG. 43 is a cross-sectional front elevational view of the swivel support assembly.
Figure 44:
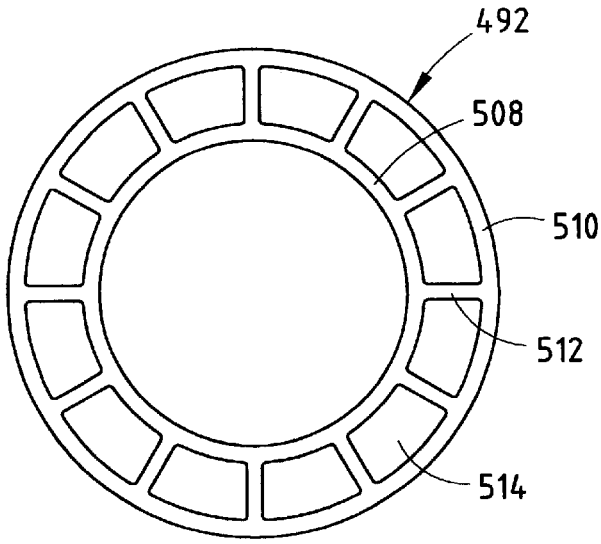
FIG. 44 is a bottom plan view of an annularly-shaped puck of the swivel support assembly.
Figure 45:
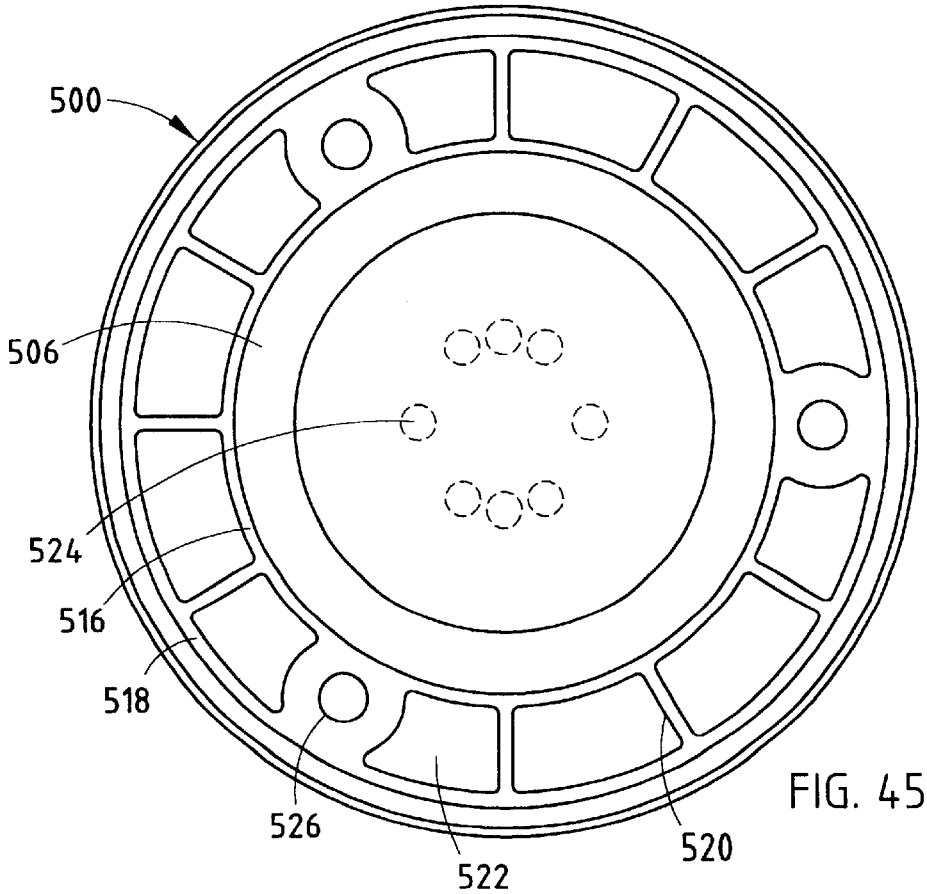
FIG. 45 is a bottom plan view of an annularly-shaped foot plate of the swivel support assembly.

The furniture system 10 further includes a swivel support assembly 490 (FIGS. 42 and 43) that includes an annularly-shaped puck 492 having a flat bottom surface 494 adapted to be supported on the floor surface 21, a flat upper surface 496, and side edge 498 beveled outwardly from upper surface 496 to bottom surface 494, and a generally annularly-shaped foot plate 500 that includes a flat upper surface 502, a flat bottom surface 504, and a downwardly-facing frusto-conical surface 506 shaped to closely receive beveled side edge 498 of puck 492 and to be operably connected to a post 16, thereby providing lateral adjustment of post 16 with respect to a beam 14.

The puck 492 of swivel support assembly 490 further includes an inner structural ring 508, an outer structural ring 510, and a plurality of structural support ribs 512 extending between inner ring 508 and outer ring 510 and defining a plurality of material saving voids 514 therebetween. The foot plate 500 also includes a structural inner ring 516, a structural outer ring 518 and a plurality of ribs 520 extending between inner ring 516 and outer ring 518 and defining a plurality of material saving voids 522 therebetween. Foot plate 500 further includes a plurality of apertures 524 adapted to receive a plurality of mechanical fasteners therein for connecting foot plate 500 with post 516 as described below, and a plurality of circumferentially-spaced apertures 526 adapted to receive mechanical fasteners therein for operably connecting foot plate 500 with floor 21.

In assembly, foot plate 500 is operably connected to an end post 16 by a plurality of mechanical fasteners such as bolts 526 that extend upwardly through apertures 524 and are received within a plurality of apertures (not shown) located within post 16. The assembly of foot plate 500 and post 16 is then placed upon puck 492 such that frusto-conical surface 506 of foot plate 500 contacts beveled side edge 498 of puck 492, thereby creating a bearing surface therebetween and allowing post 16 to be adjusted in a full 360° of lateral directions and adjusted with respect to overhead beam 14 assisting in the alignment therebetween. Subsequent to assembly of post 16 with beam 14, puck 492 is removed from beneath foot plate 500, thereby allowing bottom surface 504 of foot plate 500 to rest upon floor surface 21. A plurality of mechanical fasteners such as bolts 528 are then placed within apertures 526 of foot plate 500 and operably connect the assembly of post 16 and foot plate 500 with floor surface 21.

Figure 46:
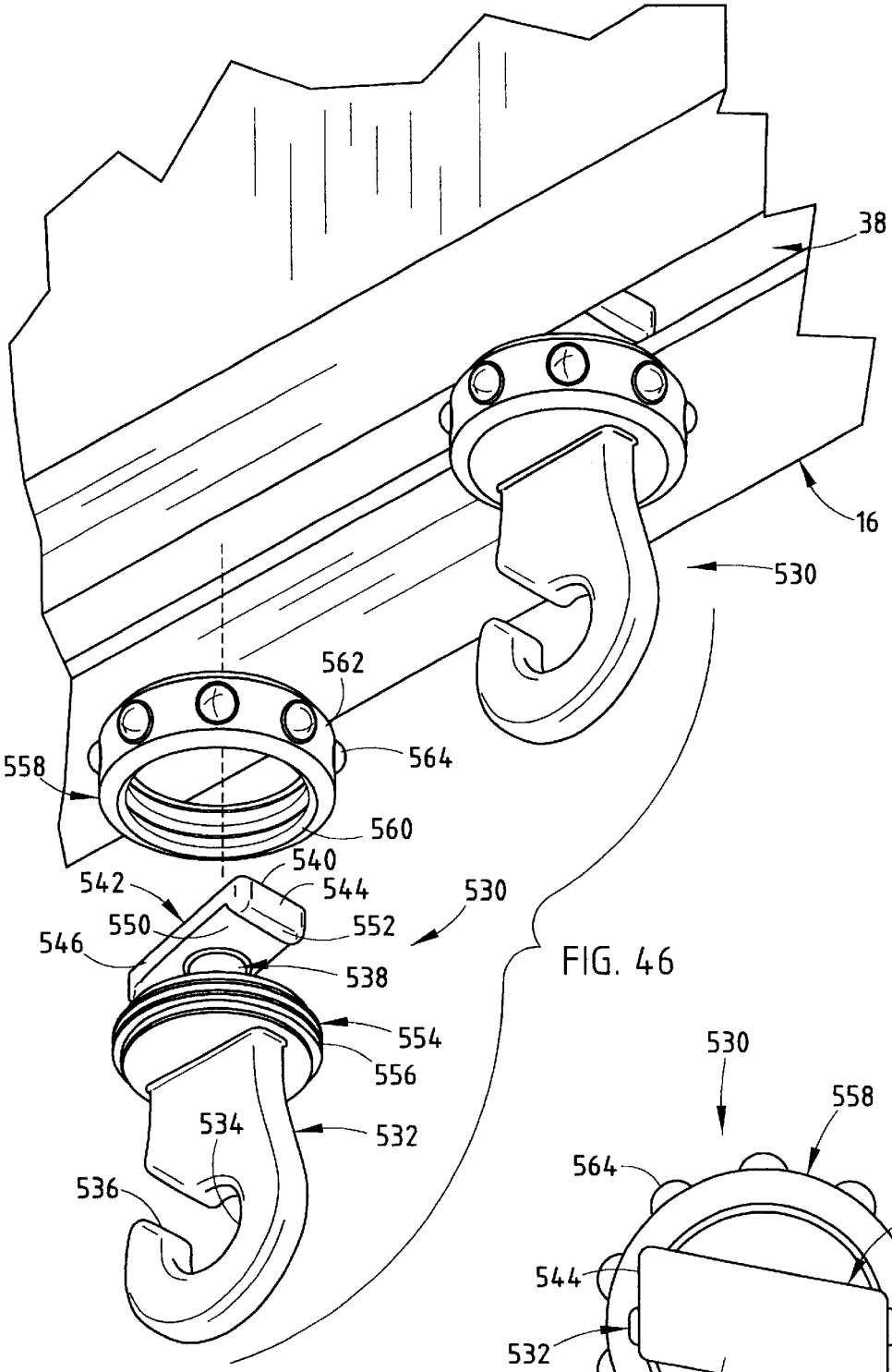
FIG. 46 is an exploded perspective view of a first universal utility hanger and a perspective view of a second universal utility hanger mounted on a horizontally-extending beam.
Figure 47:
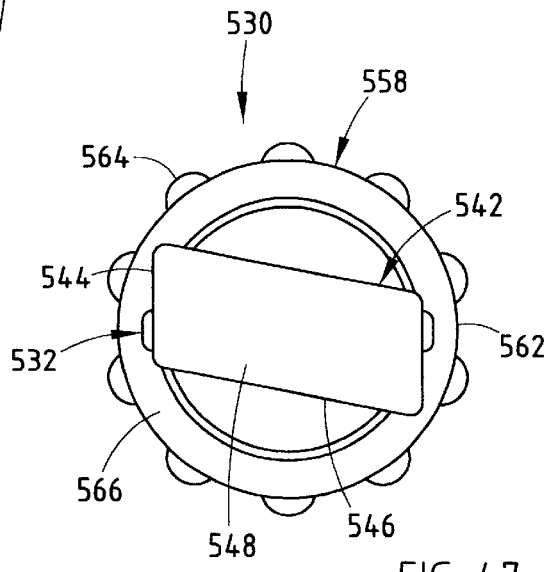
FIG. 47 is a top plan view of the utility hook.

The furniture assembly 10 further includes a universal utility hanger 530 (FIGS. 46 and 47) that includes a hook-shaped body portion 532 having a circular center aperture 534 that communicates with outwardly-extending slot 536, a cylindrically-shaped neck 538 extending upwardly from body 532 and a pair of flanges 540 that cooperate to form a head 542 that extends orthogonally to neck 528 forming a general T-shape therewith. Head 542 includes a pair of substantially parallel end walls 544 and a pair of substantially parallel side walls 546 that cooperate with end walls 544 to provide head 542 with a substantially parallelogram-like shape that is adapted to be mounted within bottom channel 38 of beam 16. Head 542 also includes an outer surface 548 located away from neck 538, and an inner surface 550 juxtaposed across head 542 from outer surface 548. Each flange 540 of head 542 includes a rounded shoulder 552 extending outwardly from inner surface 550 and adapted to be received within grooves 55 of channel 38 of beam 18 as described below.

Hanger 530 also includes a disk-shaped portion 554 disposed between neck 538 and body 532 and extending outwardly therefrom. Disk-shaped portion 554 has a threaded outer surface 556. Hanger 530 further includes a ring-shaped locking ring 558 having a centrally-located threaded aperture 560 that is adapted to threadably receive disk-shaped portion 554 therein. Locking ring 558 is partially defined by a cylindrically-shaped outer surface 562 having a plurality of outwardly-extending dimples 564 spaced circumferentially thereabout, and a radially extending contact surface 566.

In assembly, hanger 530 is mounted within channel 38 of beam 16 by aligning side walls 546 of head 542 with neck portion 39 of channel 38, moving hanger 530 vertically until neck portion 538 of hanger 530 is horizontally-aligned with neck portion 39 of channel 38 and head 542 is located within inner portion 41 of channel 38, and rotating hanger 530 until end walls 544 of head 542 contacts inner walls 47 of channel 38. The locking ring 558 is then threaded along disk-shaped portion 554 until contact surface 566 of ring 558 abuts bottom face 32 of beam 16, thereby forcing inner surface 550 and shoulders 552 into frictional engagement with inner channel wall 43 and grooves 45 of channel 38, respectively.

In the foregoing description, it will be readily appreciated by those skilled in the art that modifications may be made to the invention without departing from the concept disclosed herein. Such modifications are to be considered as included in the following claims, unless these claims by their language expressly state otherwise.

The invention claimed is:

1. In a post and beam furniture system of the type having a plurality of overhead beams, each having a longitudinally-extending first channel and a longitudinally-extending second channel, and a plurality of vertical posts each having a lower portion thereof adapted to be abuttingly supported on a floor surface of the open office space, an upper portion thereof adapted to be connected with an associated one of the beams, and at least one longitudinally extended T-shaped channel, the improvement including a connector assembly comprising:

a first L-shaped bracket having a body portion and an end portion extending substantially orthogonal to the body portion, the body portion of the first bracket being mounted in the first channel of an associated one of the beams;

a second L-shaped bracket having a body portion and an end portion extending substantially orthogonal to the body portion, the body portion of the second bracket being mounted in the second channel of the one beam;

a first T-shaped connector having a body portion and a pair of flanges extending outwardly from the body portion of the first connector, the flanges of the first connector received within the channel of an associated one of the posts, and wherein the first connector is connected with the first bracket, thereby connecting the one beam with the one post at a first location; and a second T-shaped connector having a body portion and a pair of flanges extending outwardly from the body portion of the second connector, the flanges of the second connector received within the channel of the one post, and wherein the second connector is connected with the second bracket, thereby connecting the one beam with the one post at a second location.

2. The furniture system of claim 1, further including:

a connecting rod; and wherein the body portion of the first bracket and the second bracket each include an aperture extending therethrough, and wherein the connecting rod extends through each aperture located in the body portion of the first and second brackets, and the one beam of the partition system.

3. The furniture system of claim 2, wherein the end portion of each of the first and second brackets includes an aperture extending therethrough that receives a mechanical fastener therein, and wherein the body portion of each of the connectors includes an aperture that receives the mechanical fastener, thereby connecting the first and second brackets with the first and second connectors, respectively.

4. The furniture system of claim 3, wherein the end portion of each bracket includes a pair of spaced-apart legs that receive the body portion of the first and second connectors therebetween, respectively, thereby assuring proper alignment between the first and second bracket and the first and second connectors, respectively.

5. The furniture system of claim 4, wherein each bracket includes an outwardly-extending shoulder received by the one beam of the partition system, thereby providing proper alignment of the brackets with the one beam prior to assembly therewith.

6. The furniture system of claim 5, wherein the first and second channels of the one beam are juxtaposed across the one beam.

7. The furniture system of claim 1, wherein the end portion of each of the first and second brackets includes an aperture extending therethrough that receives a mechanical fastener therein, and wherein the body portion of each of the connectors includes an aperture that receives the mechanical fastener, thereby connecting the first and second brackets with the first and second connectors, respectively.

8. The furniture system of claim 1, wherein the end portion of each bracket includes a pair of spaced-apart legs that receive the body portion of the first and second connectors therebetween, respectively, thereby assuring proper alignment between the first and second bracket and the first and second connectors, respectively.

9. The furniture system of claim 1, wherein each bracket includes a outwardly-extending shoulder received by the one beam of the partition system, thereby providing proper alignment of the brackets with the one beam prior to assembly therewith.

10. The furniture system of claim 1, wherein the first and second channels of the one beam are juxtaposed across the one beam.

11. In a post and beam furniture system of the type having a plurality of overhead beams, and a plurality of vertical posts each having a lower portion thereof adapted to be abuttingly supported on a floor surface of an open office space, an upper portion thereof adapted to be connected with an associated one of the beams, and a longitudinally-extending channel, the improvement of a positioning clip comprising:

a body section having a first end and a second end, the body section received within the channel of one of the posts;

an engagement portion located at the first end of the body section and engaging the one post; and a support portion located at the second end of the body section, received within the channel of the one post, and supporting a partition connector thereon prior to assembly of an associated one of the beams with the one post.

12. The furniture system of claim 11, wherein the engagement portion includes an outwardly-extending hook.

13. The furniture system of claim 12, wherein the hook engages an end of the one post.

14. The furniture system of claim 13, wherein the partition connector supported by the support portion is T-shaped.

15. The furniture system of claim 14, wherein the support portion includes a pair of inwardly-extending fingers.

16. The furniture system of claim 15, wherein each finger of the support portion is hook-shaped.

17. The furniture system of claim 16, further including:

at least one inwardly-extending retention finger that prevents the partition connector from being slid within the channel of the one post beyond the engagement portion.

18. The furniture system of claim 17, wherein the retention finger is received within the channel of the one post.

19. The furniture system of claim 11, wherein the engagement portion engages an end of the one post.

20. The furniture system of claim 11, wherein the partition connector supported by the support portion is T-shaped.

21. The furniture system of claim 11, wherein the support portion includes a pair of inwardly-extending fingers.

22. The furniture system of claim 11, wherein the support portion is hook-shaped.

23. The furniture system of claim 11, further including:

at least one inwardly-extending retention finger that prevents the partition connector from being slid within the channel of the one post beyond the engagement portion.

24. The furniture system of claim 23, wherein the retention finger is received within the channel of the one post.

25. In a post and beam furniture system of the type having a plurality of overhead beams, and a plurality of vertical posts each having a lower portion thereof adapted to be abuttingly supported on a floor surface of an open office space, an upper portion thereof adapted to be connected with an associated one of the beams, and a longitudinally-extending T-shaped channel, the improvement of a connector comprising:

a substantially rectangular body portion having a first end and second end; and a pair of outwardly-extending flanges located at the first end of the body portion, each flange having a distal end, an outer surface located away from the body portion, and an inner surface juxtaposed across the flange from the outer surface, each flange also having a shoulder extending outwardly from the inner surface; and wherein the body portion and flanges cooperate to define a substantial T-shape and are received within the channel of one of the posts, the shoulder of each flange received within a corresponding groove within the channel of the one post, and wherein the second end of the body portion is connected to an associated one of the beams.

26. The furniture system of claim 25, wherein each shoulder is located proximate the distal end of each flange.

27. The furniture system of claim 26, wherein each shoulder extends substantially across an entire thickness of the flange.

28. The furniture system of claim 1, wherein the body portion of the first connector is substantially rectangular shaped and has a first end and second end, the flanges extend outwardly and are located at the first end of the body portion, each flange having a distal end, an outer surface located away from the body portion, and an inner surface juxtaposed across the flange from the outer surface, each flange also having a shoulder extending outwardly from the inner surface, and wherein the body portion and flanges cooperate to define a substantial T-shape and are received within the channel of one of the posts, the shoulder of each flange received within a corresponding groove within the channel of the one post.

29. The furniture system of claim 28, wherein each shoulder is located proximate the distal end of each flange.

30. The furniture system of claim 29, wherein each shoulder extends substantially across an entire thickness of the flange.

31. The furniture system of claim 1, wherein the pair of flanges comprise a pair of end walls, a pair of side walls, wherein the end walls and the side walls cooperate to provide the flanges with a substantially parallelogram-shaped geometrical configuration and are received within the first channel of the one post, and wherein the flanges of the first bracket are rotatable within the first channel of the one post until the end walls of the flanges abut a pair of interior walls within the first channel of the one post, a first surface, and a second surface juxtaposed from the first surface and having a raised center portion that defines the body portion of the first connector, the center portion defined by a pair of engagement walls that extend outwardly from the second surface and substantially parallel to the end walls, wherein the engagement walls abut a neck portion of the channel of the one post when the end walls abut the interior walls of the first channel of the one post.

32. In a post and beam furniture system of the type having a plurality of overhead beams, each having a longitudinally-extending first channel, and a plurality of vertical posts each having a lower portion thereof adapted to be abuttingly supported on a floor surface of the open office space, an upper portion thereof adapted to be connected with an associated one of the beams, and at least one longitudinally extended T-shaped channel, the improvement including a connector assembly comprising:

a first bracket having a first portion and a second portion, the first portion of the first bracket being mounted in the first channel of an associated one of the beams; and a first connector having a body portion and a pair of flanges extending outwardly from the body portion of the first connector, the flanges of the first connector received within the channel of an associated one of the posts, and wherein the first connector is operably coupled with the first bracket, thereby coupling the one beam with the one post at a first location.

33. The furniture system of claim 32, wherein the each of the beams has a longitudinally-extending second channel, the improvement to the connector assembly further comprising:

a second bracket having a first portion and a second portion, the first portion of the second bracket being mounted in the second channel of the one beam; and a second connector having a body portion and a pair of flanges extending outwardly from the body portion of the second connector, the flanges of the second connector received within the channel of the one post, and wherein the second connector is connected with the second bracket, thereby connecting the one beam with the one post at a second location.

34. The furniture system of claim 33, wherein the first bracket and the second bracket are each L-shaped.

35. The furniture system of claim 34, wherein the first connector and the second connect are each T-shaped.

36. The furniture system of claim 33, wherein the first portion of the first bracket and the first portion of the first second bracket each include an aperture extending therethrough and that receives mounting hardware therethrough that secures the first bracket and the second bracket within the first and second channels of the one beam, respectively.

37. The furniture system of claim 36, wherein the second portion of each of the first and bracket and the second portion of the second bracket each include an aperture extending therethrough that receives a mechanical fastener therein, and wherein the body portion of the first connector and the body portion of the second connector each include an aperture that receives the mechanical fastener, thereby connecting the first and second brackets with the first and second connectors, respectively.

* * * * *

UNITED STATES PATENT AND TRADEMARK OFFICE

CERTIFICATE OF CORRECTION

PATENT NO. : 6,751,914 B2
DATED : June 22, 2004
INVENTOR(S) : Zeh et al.

It is certified that error appears in the above-identified patent and that said Letters Patent is hereby corrected as shown below:

Title page,
Item [57], ABSTRACT,
Line 13, “connectors” should be -- connector --.

Column 3,
Line 6, after “first end” insert -- and --.

Column 5,
Line 19, “assembly” should be -- assembling --.

Column 8,
Line 67, delete “is”.

Column 10,
Line 14, “provid” should be -- provide --.
Line 35, “key hole-shaped” should be -- keyhole shaped --.

Column 12,
Line 35, “Shoulder 255” should be -- Shoulders 255 --.

Column 13,
Line 31, before “294” insert -- head --.

Column 15,
Line 64, “locking plate 414” should be -- locking plate 413 --.

Column 16,
Line 57, “therefore” should be -- therefor --.

Column 19,
Line 56, “a” should be -- an --.

Column 22,
Line 13, after “wherein” delete “the”.
Line 30, “connect” should be -- connector --.

UNITED STATES PATENT AND TRADEMARK OFFICE

CERTIFICATE OF CORRECTION

PATENT NO. : 6,751,914 B2
DATED : June 22, 2004
INVENTOR(S) : Zeh et al.

It is certified that error appears in the above-identified patent and that said Letters Patent is hereby corrected as shown below:

Column 22,
Line 32, before “second” delete “first”.
Line 38, after “portion” delete “each of”.
Line 38, after “first” delete “and”.

Signed and Sealed this

Twelfth Day of October, 2004

JON W. DUDAS
*Director of the United States Patent and Trademark Office*